US006389983B1

(12) United States Patent
Coester et al.

(10) Patent No.: US 6,389,983 B1
(45) **Date of Patent: *May 21, 2002**

(54) CONTROL CIRCUIT FOR OPERATION OF PNEUMATICALLY PROPELLED VEHICLES

(75) Inventors: Oskar Hans Wolfgang Coester; Claudio Farao Souza Pinto, both of Porto Alegre (BR)

(73) Assignee: Aeromovel Global Corporation, Georgetown (KY)

( * ) Notice: Subject to any disclaimer, the term of this patent is extended or adjusted under 35 U.S.C. 154(b) by 0 days.

This patent is subject to a terminal disclaimer.

(21) Appl. No.: 09/597,934

(22) Filed: Jun. 20, 2000

Related U.S. Application Data

(63) Continuation of application No. 08/952,573, filed on Nov. 10, 1997, now Pat. No. 6,076,469.

(51) Int. Cl.[7] ..... B61B 13/00
(52) U.S. Cl. ..... 104/155; 104/138.1
(58) Field of Search ..... 104/138.1, 154, 104/155, 156, 157; 105/365

(56) References Cited

U.S. PATENT DOCUMENTS 3,999,487 A * 12/1976 Valverde ..... 104/138.1
6,076,469 A * 6/2000 Coester ..... 104/155

* cited by examiner

*Primary Examiner*—S. Joseph Morano
*Assistant Examiner*—Robert J. McCarry, Jr.
(74) *Attorney, Agent, or Firm*—Donald L. Beeson

(57) ABSTRACT

The improvement in a control circuit for the operation of pneumatically propelled vehicles consists of a propulsion duct formed by a guideway (1) and power propulsion units (3) with flow control valves (4) located at intervals along the guideway (1). Atmospheric valves (2) are located at specific points along the guideway (1), opening and closing the duct to the atmosphere, and the section isolation valves (6) are positioned in such a way as to isolate adjacent blocks of the guideway (1) and at the same time to maintain the functioning of the propulsion circuit in the other blocks. A secondary duct (7) can be provided to allow a propulsion unit installed at a vehicle station to propel a vehicle which is stopped at the station.

31 Claims, 9 Drawing Sheets

CONTROL CIRCUIT FOR OPERATION OF PNEUMATICALLY PROPELLED VEHICLES

CROSS-REFERENCE TO RELATED APPLICATIONS

This is a continuation of application Ser. No. 08/952,573, filed Nov. 10, 1997, now U.S. Pat. No. 6,076,469.

TECHNICAL FIELD

The present invention relates to an improvement in pneumatic circuits for controlling the movement of pneumatically propelled vehicles along a track or line that has several stations.

BACKGROUND ART

A system for the pneumatic propulsion of cargo or passenger vehicles is disclosed in Brazilian Pat. No. 7,703,372, filed on May 25, 1977 (25.05.77). This system consists of a tube equipped with a longitudinal slot with a sealing system through which passes a rod or shaft attached to a set of fins on the chassis of the vehicle, supported by the tube, with the propulsion being provided by means of an airflow of high-speed acting on the set of fins, propelling it and, as a result, moving the vehicle freely, by means of devices that are adequate to enable this movement/motion, with the flow in question being generated by stationary sources located outside the vehicle, with the system in question also including brakes that act directly on the said devices and special conduits for enclosing the electrical and telephone network cables.

The pneumatic propulsion system described above for the transport of cargo or passengers is characterized by the fact that the vehicles are propelled pneumatically by means of stationary units, inasmuch as the system has the following goals: to provide an urban transportation system on a scale that meets current and future needs; to combine, in a single design, optimal characteristics in terms of vehicles, permanent trackway, and terminals; to provide significant progress in economic effectiveness in urban transportation; and to provide speed, regular service, comfort, and safety at reduced costs.

Brazilian Pat. No. 7,906,255, filed on Sep. 28, 1979 (28.09.79), proposed an improvement in a pneumatic propulsion system for cargo vehicles and passenger vehicles. This improvement consisted of a propulsion duct which, in addition to serving as a channel for air for the propulsion of the vehicle, also had the additional function of providing the necessary structure for installation in the elevated network of the transportation system, i.e., its own structure for the propulsion duct, consisting of a single channel in conjunction with tracks or rails forming an integral part of the said structure, thereby making unnecessary any other structures for the support of the rails, except the structures for supporting or keeping the main structures above the ground, spaced at sufficiently large intervals so as not to interfere with surface traffic.

Another important characteristic of the system is that when a suction regime is established in the duct, the difference between the internal and external pressure acts to compress a flexible flap against a stop, sealing the longitudinal slot in the duct, and at the same time allowing the passage of the articulation arm of the fin of the vehicle through a mechanical gap, such that because of its flexibility, this flap provides an adequate seal even under over-pressure conditions in the duct, with a system also being provided for the relief of the internal pressure within the propulsion duct.

The system in question is also equipped with a flow alternator mounted in conjunction with each blower, in combination with a flow control valve, by means of which the airflow conditions within the duct can be controlled, which in turn determine the back and forth movements of the vehicle by remote control, as a function solely of the commands issued to the flow alternator. The system in question also includes a set of valves at each station, positioned such that they provide control means for a safety system that ensures the positive separation of two vehicles under any circumstances.

Brazilian Pat. No. 83 01 706, filed on Apr. 4, 1983 (04.04.83), describes improvements in a pneumatic propulsion system for cargo vehicles and/or passenger vehicles. In the pneumatic propulsion system in this invention, the vehicle is controlled through the regulation of the airflow in the propulsion air duct, with this type of regulation being implemented by means of butterfly-type control valves, in association with a single airflow generator. Through their position, these valves determine the direction of the airflow in the duct, its speed, and the pressure differential (within the discharge and pressure range of the generator unit). A set of four valves associated with the generator unit connects the suction and exhaust manifolds to the air propulsion duct and to the atmosphere.

The documents cited above do not provide sufficient means for adequate control of the movements of vehicles along the line. The operation of a pneumatically controlled propulsion transportation system requires that control elements be provided for maintaining adequate vehicle frequency, regulating vehicle traffic, ensuring the effective movement of vehicles over the entire length of the line, and establishing safe conditions for the vehicles during operation, along with other equally important factors.

DISCLOSURE OF INVENTION

The goal of the present invention is an improvement in a control circuit for the operation of pneumatic propulsion vehicles, so that these vehicles can be adapted to the widest possible range of situations applicable in a transportation system, meeting requirements and objectives such as the ones listed below, i.e.:

Maintaining an adequate frequency between vehicles in order to provide the transportation capacity and the level of transportation service required in each application;

Arranging the propulsion elements in such a way as to allow different locations to for the power propulsion units as a function of the spaces available in each application site, bearing in mind the fact that the power propulsion units are volumetrically the largest elements in the propulsion system;

Obtaining different levels of intensity for the propulsive thrust, for example, by combining the action of one or two power propulsion units, simultaneously or not, depending on the performance required from the vehicle under various load conditions;

Establishing safe conditions for the vehicles in operation simultaneously on a single line, by means of independent propulsion circuits;

Obtaining redundancies in the propulsion system in order to continue the operation of vehicles in the event of a failure in one or more pieces of equipment in the propulsion system;

Adding atmospheric valves located at specific points along the line, so that the duct can be opened or closed to the atmosphere without interfering with the inside space of the propulsion duct, while improving the controllability of the propulsion system and creating on the airflow circuits within the duct;

Making it possible for vehicles to depart at the same time from two contiguous stations;

Making it possible for vehicles to reach their respective stations at the same time;

Making it possible for one vehicle to arrive at a station while another vehicle is moving in the preceding section;

Making it possible for one vehicle to arrive at a station while another vehicle is moving in the section between stations, with a third vehicle being stopped at the next station for boarding or loading and unloading;

Making it possible for one vehicle to be located at a station while a second vehicle is in motion in the section ahead and a third vehicle is stopped at the next station;

Adding assemblies consisting of section isolation valves and atmospheric valves, appropriately located throughout the length of the line, with the valves being operated in a given sequence and at given timing, thereby making it possible for the section isolation valve to be closed or open during periods when the duct is not being pressurized by an airflow, thereby allowing such valves to be actuated with minor forces, and also allowing the system to operate safely by preventing a vehicle's propulsion plate from hitting the shutter of the section isolation valves and atmospheric valves proposed in the earlier patents; and During the vehicle deceleration phases, the arrangement of atmospheric valves, section isolation valves, and/or power propulsion units, depending on the circumstances, so as to make it possible to avoid the use of propulsive force, which would be applied only when necessary and in instances when the vehicle is in forward motion; that is, the propulsion system is not used (and therefore no motive power is consumed) to brake the vehicle by means of a pressurized airflow acting against the vehicle movement. The vehicle is decelerated without consuming propulsion power, for this purpose relying instead on the partial or total closure of the propulsion duct in the section in which the vehicle is located, using a combination of the flow control valves in the power propulsion unit and/or the atmospheric valves. As a complement to the braking force of the vehicle, a friction brake is applied to the wheels. The atmospheric valves, or a combination of to the positions of the airflow control valves in the power propulsion unit are used to implement the connection between the propulsion duct and the atmosphere, allowing movement (when necessary) of the vehicle without pneumatic resistance from the propulsion system.

Another goal of the present invention is to create safe conditions for the passive deceleration and braking of a vehicle on the end of the line in the event that the vehicle inadvertently enters this portion of the line. To do so, safety circuits are used by providing an additional extension of the propulsion duct, closed at the end with a plug, so that the set consisting of the vehicle propulsion plate, the line duct,.and the plug at the end of the duct function as a system that stops the progress of the vehicle, thereby providing a damping action due to the compression of the air.

The invention also includes an improvement in the power propulsion unit consisting of connecting this unit to the propulsion duct of the guideway by means of a single opening on the guideway duct and using a combination of positions for the airflow control valves, all closed, or in such a way as to connect the duct to the atmosphere without, however, generating an airflow, thereby allowing the power propulsion unit to operate in the same way as an atmospheric valve, i.e., either opening or not opening the duct to the atmosphere.

The invention includes improved atmospheric.valves connected to the propulsion duct, which, when necessary, allow the pressure in the duct to be relieved. The atmospheric valves are located appropriately along the length of a given segment of the line. At the same time, these atmospheric valves, either in open or closed position, allow the vehicle to move in such a way that it passes beyond the location of these valves without obstructing the propulsion plate of the vehicle within the duct by any type of shutter or obturator, thereby allowing the system to be controlled by means of several possible configurations for valves and power propulsion units.

In order to allow full understanding of the improvement in the control circuit for the operation of pneumatically propelled vehicles which is the object of the present invention, the following such improvement is described in detail, with reference to the attached drawings:

BEST MODE FOR CARRYING OUT THE INVENTION

Figure 1:
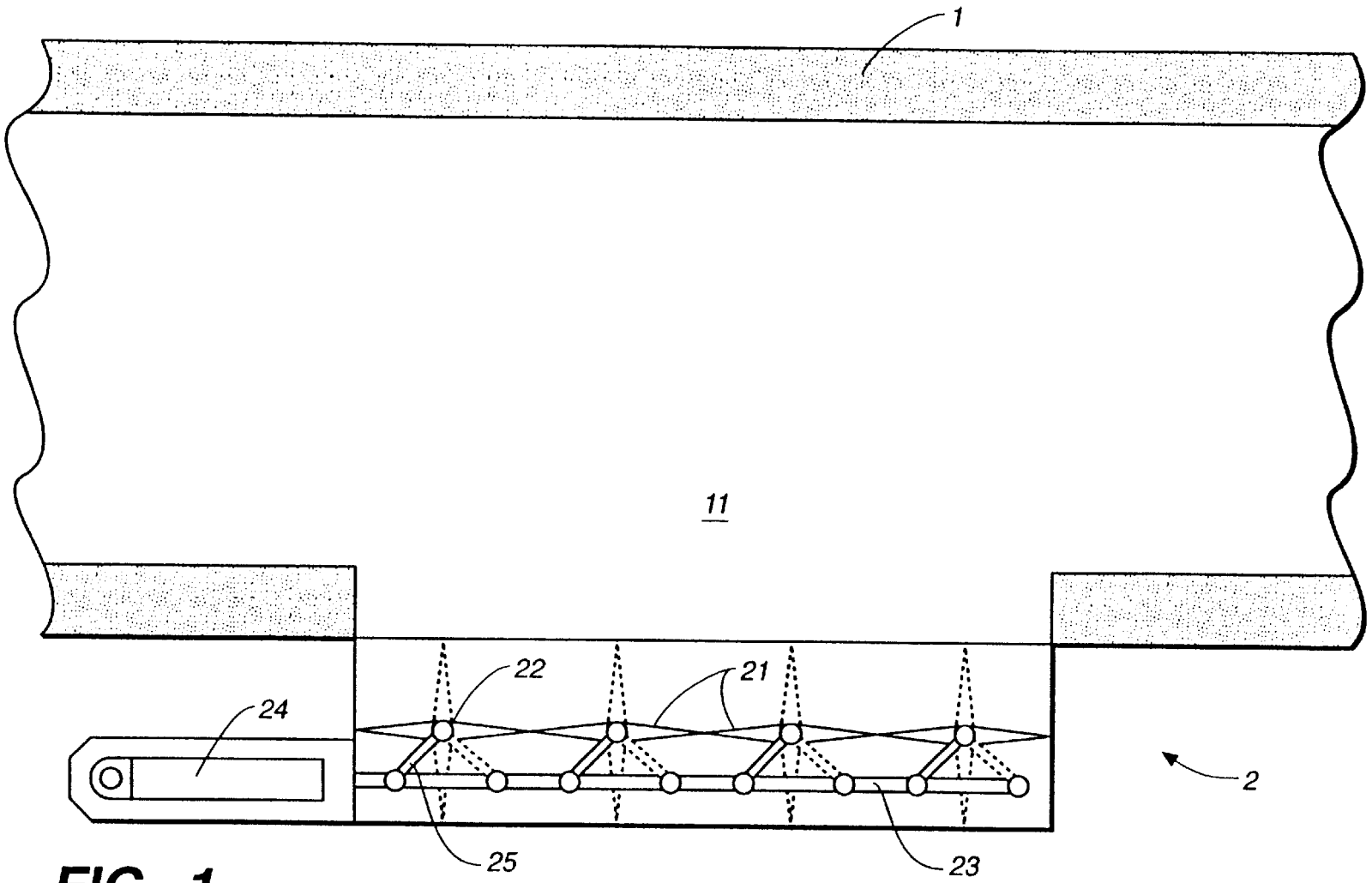
FIG. 1 is a side view of a longitudinal cross-section of the propulsion duct with an atmospheric valve.
Figure 2:
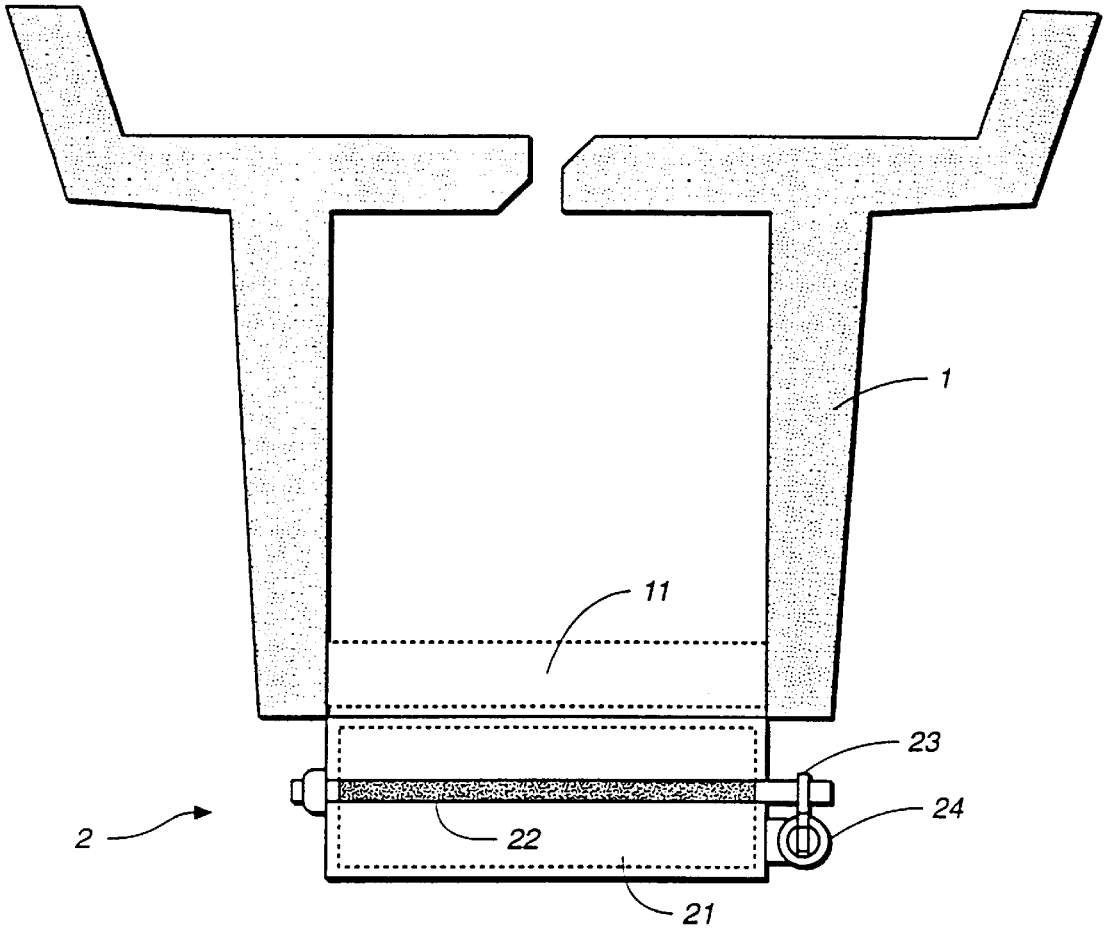
FIG. 2 is a front view of a transverse cross-section of a duct with an atmospheric valve.

FIGS. 1 and 2 represent the installation of an atmospheric valve (i.e., a valve that opens and closes the duct) connected to an opening (11) in the lower plane of the beam of the duct (1). The atmospheric valve (2) consists of a butterfly-type valve with multiple pivoting panels (21) that open and close the duct with each panel (21) pivoting around an axis and with all of the axes being interconnected by means of an arm (23), which is actuated in order to open or close the pivoting panels by means of a hydraulic or pneumatic actuating cylinder (24). These figures also show an atmospheric valve (2) with four pivoting panels (21). This valve can also consist of a larger number of panels connected in the same way, so as to constitute a larger surface for the opening of the valve. This can be advantageous in order to allow the airflow to pass through the atmospheric valve at low speed, because a high airspeed can cause noise or even offer an undesirable amount of resistance to the passage of air across the surface of the valve opening.

The action of the actuating cylinder (24) determines the position of the pivoting panels (21) of the atmospheric valve, so as to close the guideway duct (1) completely or, alternatively, to open the duct to the atmosphere. It should be pointed out that the pivoting panels (21) have their axis of rotation (22) centred on the surface of the panels, providing a balancing effect for the propulsion airflow, inasmuch as the pressure differential acts on the surface of each pivoting panel (21) symmetrically in relation to the axis of rotation (22) of the panel, thereby minimizing the forces that actuate the valve (2).

When the atmospheric valve (21) is in the closed position, the pivoting panels (21) include an outlined indication of the position of these panels when the valve is open. The panels (21) are mounted along revolving axes (22), which are connected by means of a system of connecting rods (25) to an arm (23), which is shifted by a hydraulic or pneumatic actuation cylinder (24), which, by moving the arm (23) in one direction or the other, positions the pivoting panels (21) so as to open or close the tube (1) to the atmosphere. FIG. 1 shows the position of the pivoting panels (21) when they are closing the guideway duct (1) to the atmosphere, with the drawn lines indicating the position of these panels (21) for the valve in the open position, i.e., when the guideway duct (1) has been opened to the atmosphere.

Figure 3:
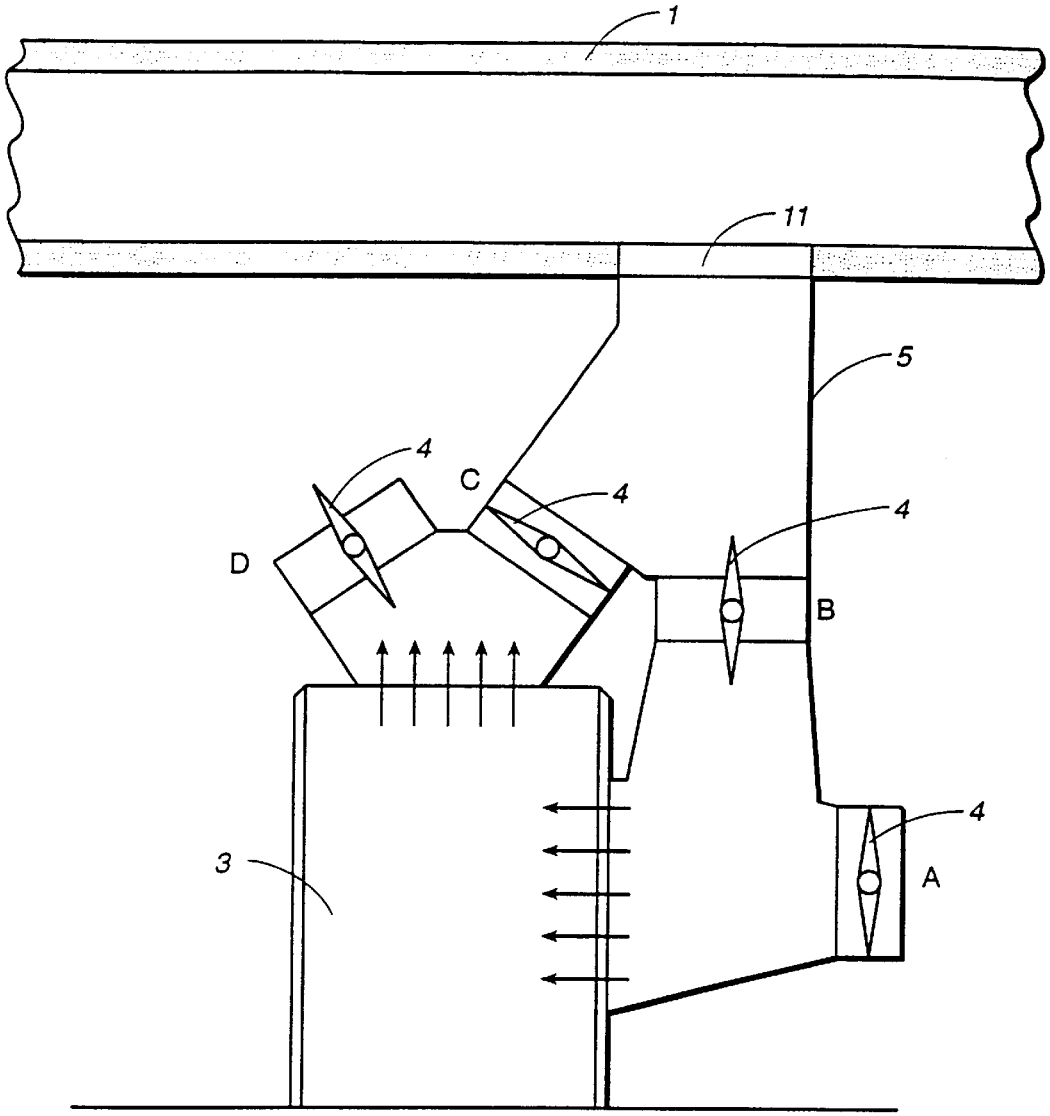
FIG. 3 is a side view of a longitudinal cross-section of a duct with a power propulsion unit.

FIG. 3 illustrates the improved power propulsion unit (3) that consists of a stationary airflow generation unit, connected to the guideway by means of a connecting duct and provided with a set of four butterfly-type control valves, which are controlled, for the open or closed positions, by means of a valve command and control system, which consists of:

a) Using a single duct, rather than two ducts, to connect the set (of valves) to the duct formed by the guideway, thereby reducing the dead length of the guideway duct that is characterized when the propulsion plate of the vehicle passes over the apertures with connections for the airflow generation units; the utilisation of a single duct to connect the power propulsion unit with the air propulsion duct for the line allows the components to be simplified, with a reduction of the volume occupied by the set (of valves) and a reduction in the number of apertures in the beam structure that forms the duct, thereby resulting in a structural improvement in the guideway structure. Notice should be taken of the fact that the guideway is open at the top in order to allow passage of the mast of the vehicle propulsion plate, with the rest of the cross-section of the beam forming a supporting structure that should be of an appropriate size to withstand the effects of the pressure in the duct, which requires the smallest possible number of apertures in a given length of the beam subjected to a vacuum; and b) Creating three more combinations of open and closed control valves, such that in one of the combinations of positions, referred to as "neutral," all of the control valves are closed so as to cause the complete closure of the guideway duct at the position on which the airflow generation unit is installed, while in the other two combinations of positions for the control valves the guideway duct is connected to the atmosphere airflow being supplied to the guideway duct by the generation unit, with the latter functioning as a valve that opens or closes the duct to the atmosphere. The chart below lists the combinations of the positions of the four airflow control valves.

| | OPERATING MODE | | | | |
|---|---|---|---|---|---|
| VALVE | SUCTION | PRESSURE | NEUTRAL | ATMOSPHERE | ATMOSPHERE |
| A | CLOSED | OPEN | CLOSED | CLOSED | OPEN |
| B | OPEN | CLOSED | CLOSED | CLOSED | OPEN |
| C | CLOSED | OPEN | CLOSED | OPEN | CLOSED |
| D | OPEN | CLOSED | CLOSED | OPEN | CLOSED |

FIG. 3 shows the guideway beam (1) with the power propulsion unit connected by means of an aperture (11) on the lower plane of the guideway beam; a stationary centrifugal blower (3) or other type of airflow generation unit provided at the source of the propulsive airflow for the system; a set of four butterfly-type airflow control valves (4); and an interconnection duct (5) that links. the entire set atmospheric valve—the power propulsion unit—to the guideway duct (1).

Figure 4:
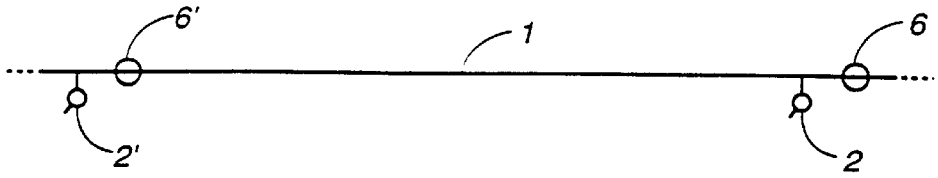
FIG. 4 is a schematic diagram of a block isolation circuit.

FIG. 4 shows the isolation circuit for a guideway block consisting of a section of the propulsion duct formed by the guideway (1) along which the vehicle moves, where two atmospheric valves (2) (2') are installed, along with two section isolation valves (6) (6'), so as to isolate adjacent blocks of the guideway while at the same time maintaining the functioning of the propulsion circuit for the independent operation of the vehicles in the respective blocks. Two or more contiguous section isolation circuits, located along the entire extent of a line in a transportation system, can function in combination, so as to provide specific different effects, in accordance with the arrangement of the elements of the propulsion system described below.

Considering the guideway section (1) that constitutes an isolated propulsion circuit and also separates the adjacent propulsion circuits, such section is defined by the spacing between two sets formed by an atmospheric valve (2) and a section isolation valve (6) installed in the propulsion duct (1). Two atmospheric valves (2) (2') are installed on the internal portion of the safety circuit.

Section isolation valves (6) (6') are installed at the ends of the section isolation circuit, before and after the location of the atmospheric valves (2) (2').

The direction of travel of one or more vehicles on the line to which the block isolation circuit belongs is considered as defined from the section isolation valve (6') to the section isolation valve (6).

When the section isolation valves (6) (6') are closed, the sections adjacent to the section isolation circuit are isolated, thus, there is no airflow in the guideway duct (1) in the segment of the block isolation circuit. The optional inclusion of a power propulsion unit (3) at the beginning or at the end of the section isolation circuit can propel a vehicle within the guideway segment of the section isolation circuit. If the power propulsion unit (3) is located at the beginning of the section isolation circuit, then this power propulsion unit can propel a vehicle within this section isolation circuit by means of the handling of an airflow in the pressure regime, in which case the atmospheric valve (2) is opened to allow the airflow to exit from the guideway duct (1) and the atmospheric valve (2') is closed. If the power propulsion unit (3) is located at the end of the section isolation circuit, then this power propulsion unit can propel a vehicle located in this section isolation circuit by generating an airflow in the negative air pressure regime, in which case the atmospheric valve (2') is open in order to allow air to pass from the atmosphere into the guideway duct (1), and the atmospheric valve (2) is closed.

When the section isolation valve (6') is open, the atmospheric valve (2') is closed, the atmospheric valve (2) is open, and the section isolation valve (6) is closed, the section isolation circuit is open for entry of the vehicle into the segment of the guideway (1) consisting of the section isolation circuit. The propulsion circuit for the guideway section located beyond the section isolation valve (6) is isolated from the preceding circuit in which the vehicle is located.

When the section isolation valve (6') is closed, the atmospheric valve (2') is open, the atmospheric valve (2) is closed, and the section isolation valve (6) is open, the isolation circuit is open for entry of the vehicle into the segment of the guideway located beyond the isolation circuit. The section before the isolation circuit located ahead of the section isolation valve (6') is isolated from the circuit in which the vehicle is located if the vehicle is exiting from the section isolation circuit.

If a loading and unloading station is located within the segment consisting of a to section isolation circuit, the latter allows a vehicle coming from a preceding circuit to enter the segment consisting of the loading platform, to stop at the station, and then to enter the next block, with the propulsion of the vehicle being provided by an airflow generated by power propulsion units (3) located in the respective blocks before and after the station.

The isolation circuit isolates the two guideway blocks adjacent to it in such a way that a vehicle in operation remains under propulsion, in motion, and all of the valves of the isolation circuit are operated safely, as long as the vehicle and its propulsion plate are located sufficiently far from a section isolation valve and no positive or negative propulsive air pressure acts on the section isolation valves while these valves are operated (i.e., from open to closed or from closed to open). The lack of positive or negative air pressure acting on the surface of a section isolation valve in an isolation circuit makes it possible to operate the valve with reduced actuation effort, thereby requiring less power, simplifying the structure of the valve and the actuation mechanisms, and also reducing the risk of a collision between the vehicle propulsion plate and the valve shutter, because the valve is operated so as to open or close when the duct in which it is installed is not pressurized, i.e., when no vehicle is too close.

Figure 5:
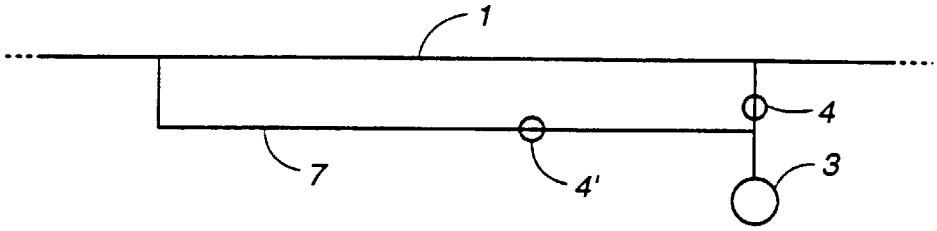
FIG. 5 is a schematic diagram of a secondary propulsion circuit.

A secondary propulsion circuit, illustrated in FIG. 5, consists of an air duct (7) that runs parallel to the main duct formed by the guideway (1) and that is equipped with two airflow control valves (4) (4') which are connected to it. The secondary propulsion circuit is used to connect the airflow generated by a power propulsion unit (3) at two locations on the main duct formed by the guideway (1), with these positions being such as to allow the airflow to be applied on one side or the other of the vehicle propulsion plate. In this way, the vehicle can be operated in one direction of travel or the other in situations in which the power propulsion unit (3) installed directly on the main duct (1) cannot propel a vehicle (e.g., when a vehicle or its propulsion plate is located within, directly below the position of the power propulsion unit (3)). The airflow control valves (4) (4') that form part of the secondary propulsion circuit are of the same type used in the power propulsion unit (3), inasmuch as their position is either closed or open in order to direct the airflow generated by the power propulsion unit (3) into one or the other position of the guideway duct (1). The duct used in the secondary propulsion circuit (7) may form an integral part of the guideway duct (1), or may be an independent structure. The cross-section of the duct (7) used in the secondary propulsion circuit is of appropriate size to meet the requirements of each application in accordance with the airflow pressure and vacuum required in that circuit, and also in terms of the level of performance desired for the vehicle.

The secondary propulsion circuit consists of a secondary duct (7) that is connected to the guideway duct (1) at two locations, plus two airflow control valves (4) (4'), each of which is located in one of the branches of the secondary duct (7), which is bifurcated at the point at which the power propulsion unit (3) is connected.

The position of the power propulsion unit (3), in relation to the secondary duct (7) is determined so that the power propulsion unit is parallel to the guideway duct (1) in such a way that the airflow generated by the power propulsion unit (3) is directed toward the branch of the secondary duct (7) parallel to the guideway duct (1) in situations in which vehicles are operated for short periods of time. The power propulsion unit (3) is connected to the guideway duct (1) by means of the shorter branch of the secondary duct (7) during most of the time when the vehicle is in operation. In this way, hard losses in the air pressure along the majority of the guideway duct length are minimized.

With the power propulsion unit (3) providing an airflow in the positive or negative air pressure regime, the airflow control valves (4) (4') in the secondary propulsion circuit are alternately closed and open in order to direct the airflow toward one or another point at which the secondary propulsion circuit is connected to the guideway duct (1). This arrangement allows the power propulsion unit (3) to direct the airflow to actuate, on one or the other side, the propulsion plate of the vehicle located in the segment parallel to the secondary propulsion circuit.

Figure 6:
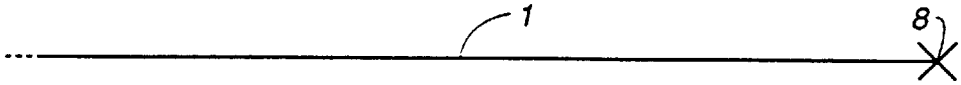
FIG. 6 is a schematic diagram of a safety circuit at the ends of the line.

An end-of-line safety circuit, illustrated in FIG. 6, consists of an additional segment of the propulsion duct formed by the guideway (1), in which the duct is closed at the end with a plug (8), so as to encourage the deceleration and stopping of a vehicle that has inadvertently entered this circuit, imposing this action by means of the air pressure created in the duct (1) by the movement of the propulsion plate in this closed pneumatic circuit that has no aperture for expulsion of the air, which is gradually compressed and whose pressure acts in a direction opposite to the direction of motion of the vehicle.

In each application design, the length of the end-of-line (1) safety circuit is determined in accordance with the velocity and mass of the vehicle, the dimensions of the duct, and the forces against the vehicle movement. This segment is considered to start at the point at which the vehicle starts to compress the air, and continue up to the point at which the vehicle stops or reaches a sufficiently low velocity as a result of the motion of the propulsion plate due to air leakage in the circuit.

Figure 7:
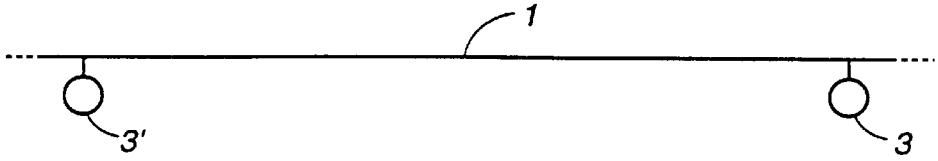
FIG. 7 is a schematic diagram of a dual propulsion circuit.

The dual propulsion circuit shown in FIG. 7 consists of a guideway (1) in which a power propulsion unit (3) located behind the vehicle propels the vehicle by means of air pressure, while another power propulsion unit (3), located ahead of the vehicle, provides propulsion by means of negative air pressure (i.e., below atmospheric pressure). In this case, a vehicle in the dual propulsion circuit can be propelled by as much as twice the thrust generated by a power propulsion unit, because while on one side one power propulsion unit generates positive air pressure so as to push the vehicle, on the other side a second power propulsion unit generates negative air pressure so as to pull the vehicle. As a result, the thrust acting on the vehicle propulsion plate corresponds to the sum of the air pressure generated by each of power propulsion units. This type of dual propulsion circuit has the following advantages:

The vehicle is propelled by a thrust whose intensity is up to twice that of the thrust generated by a power propulsion unit, as produced through the simultaneous action of the power propulsion units; one of which generates positive air pressure and the other of which generates negative air pressure;

Besides the fact that the propulsion thrust can be up to twice as strong as the thrust obtained through the action of a (single) power propulsion unit, the air pressure in the structure of the propulsion duct formed by the guideway is not affected; that is, a dual propulsion circuit does not require any additional structural reinforcement in the guideway duct; and, because the positive and negative air pressures act separately, from one side and the other of the vehicle propulsion plate, the effect of the resulting pressure acting on the vehicle propulsion plate is significantly greater; and Is In the dual propulsion circuit, the two power propulsion units may be utilized either simultaneously or individually, depending on the amount of propulsion necessary in any given situation, thereby allowing optimization of the use of one or two power propulsion units depending on need and on the desired level of performance of the vehicle.

Figure 8:
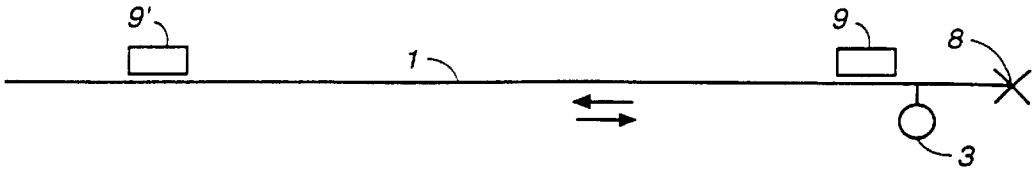
FIG. 8 is a schematic diagram of a basic vehicle control circuit.

The arrangement of the elements of the propulsion system as shown in FIG. 8 is characterized by the fact that it allows a vehicle to be operated in both directions of travel, on a single track, with two or more stations (9) located along the length of the block, with a power propulsion unit (3) being located at one of the ends, between the end of the guideway (1) and the first passenger station (9), with this power propulsion unit (3) sometimes generating positive air pressure in the duct and sometimes generating negative air pressure in the duct, in order to allow the vehicle to be operated in one direction or the other. The propulsion duct (1) is closed at the end near the power propulsion unit (3) and open to the atmosphere at the opposite end. The side on which the power propulsion unit (3) is installed is equipped with a safety circuit formed by an additional guideway duct length (1) between the power propulsion unit (3) and the end of the line, in conjunction with a plug (8) that closes the end of the duct.

The elements of the propulsion system involved in the operation of the system include the propulsion duct formed by the guideway (1), a power propulsion unit (3), a plug (8) that closes the end of the duct, and passenger stations (9) (9').

When a vehicle is stopped at a station (9), the power propulsion unit (3) positions its four control valves such that the power propulsion unit provides a flow of pressurized air. The pressure of the air acting on the vehicle propulsion plate causes the vehicle to accelerate and move in a direction toward the other station (9). Other passenger stations can be included between the stations (9) (9'), in which case the vehicle decelerates and stops at each of these stations and then resumes its movement toward the next station, continuing in the same manner until it reaches the last station (9). When the vehicle is operated in the other direction, it starts from the station (9') and moves toward the station (9), once again accelerating, decelerating, and stopping at each station that may be included in the block between the terminal stations (9') (9). When, during the deceleration stage, the power propulsion unit (3) closes all of the four control valves that are connected to it, the airflow stops. In order for the vehicle to move from the station (9') to the station (9), the power propulsion unit (3) shifts to providing a flow of air under a negative pressure regime; that is, it shifts to generating pressure that is lower than atmospheric pressure, and as a result pulls the vehicle.

Figure 9:
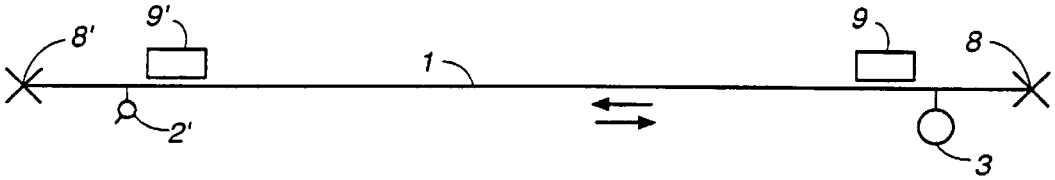
FIGS. 9 through 26 are schematic diagrams of optional vehicle control circuits.

The arrangement of the elements of the propulsion system as shown in FIG. 9 is characterized by the fact that it allows a vehicle to be operated in both directions of travel on a single track guideway (1) with two or more stations (9) (9') located along the length of the section, with a power propulsion unit (3) being located at one of the ends, between the end of the line (1) and the first passenger station (9), with this power propulsion unit (3) sometimes generating positive air pressure in the duct and sometimes generating negative air pressure in the duct, as necessary, in order to allow the vehicle to be operated in one direction or the other. The difference between this arrangement and the arrangement described above lies in the fact that in this arrangement, the propulsion duct (1) is closed at both ends, with the power propulsion unit (3) being installed near one end, while an atmospheric valve (2) is installed near the other end in order to allow air to enter or leave the duct (1) when the vehicle is being propelled, with the atmospheric valves (2) also allowing the propulsion duct (1) to be closed or open in order to encourage the deceleration or stopping of the vehicle at the next station (9).

The elements of the propulsion system involved in the operation of the system include the propulsion duct formed by the guideway (1), power propulsion unit (3), a plug (8) that closes the end of the duct, and passenger stations (9) (9').

With the vehicle stopped at a station (9), the power propulsion unit (3) positions its four control valves such that the power propulsion unit provides a flow of pressurized air. The pressure of the air acting on the vehicle propulsion plate causes the vehicle to accelerate and move in a direction toward the other station (9'). Other passenger stations can be included between the stations (9) (9'), in which case the vehicle decelerates and stops at each of these stations and then resumes its movement toward the next station, continuing in the same manner until it reaches the last station (9). When the vehicle is operated in the other direction, it starts from the station (9') and moves toward the station (9), once again accelerating, decelerating, and stopping at each station that may be included in the block between the terminal stations (9') (9). When, during the deceleration stage, the power propulsion unit (3) closes all of the four control valves that are connected to it, the airflow stops. In order for the vehicle to move from the station (9') to the station (9), the power propulsion unit (3) shifts to providing an airflow under negative pressure regime; that is, the power propulsion unit shifts to generating pressure which is lower than atmospheric pressure and thereby pulls the vehicle.

The advantage of this arrangement over the previous one lies in the fact that it provides greater flexibility and safety for stopping the vehicle. If it should become necessary to stop the vehicle, the propulsion duct (1) can be closed at both ends, on the one hand, by closing the four control valves in the power propulsion unit (3), and, on the other hand, by closing the atmospheric valve (2). With the duct (1) closed at both ends, the displacement of the vehicle propulsion plate within the duct causes the occurrence of a counterpressure in front of the vehicle, while a negative pressure area appears behind the vehicle. The overall effect of these pressures is to cause a dual deceleration of the vehicle, as a result of the counterpressure in front of the vehicle and the negative pressure behind it.

The elements of the propulsion system involved in the operation consist of the propulsion duct formed by the guideway (1), a power propulsion unit (3), an atmospheric valve (2), and two plugs (8) (8') located at the ends of the duct, so as to form a safety circuit at each end of line.

With the vehicle stopped at a station (9), the power propulsion unit (3) positions its control valves such that the power propulsion unit provides a flow of pressurized air. The atmospheric valve (2) is set to the open position in order to allow the airflow to be discharged from the duct (1). The pressure of the air acting on the vehicle propulsion plate causes the vehicle to accelerate and move in a direction toward the other station (9'). Other passenger stations can be included between the stations (9) (9'), in which case the vehicle decelerates and stops at each of these stations and then resumes its movement toward the next station, continuing in the same manner until it reaches the last station (9). When the vehicle is operated in the other direction, it starts from the station (9') and moves toward the station (9), once again accelerating, decelerating, and stopping at each station that may be included in the block between the terminal stations (9') (9). When, during the deceleration stage, the power propulsion unit (3) closes all of the four control valves that are connected to it, the airflow stops. In order for the vehicle to move from the station (9') to the station (9), power propulsion unit (3) positions its control valves such that the power propulsion unit shifts to providing a negative airflow regime; that is, the power propulsion unit shifts to generating pressure that is lower than atmospheric pressure, thereby pulling the vehicle.

Figure 10:
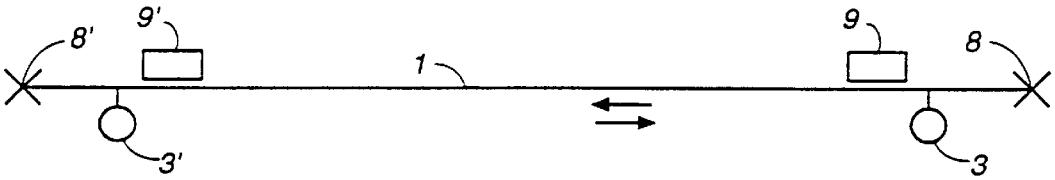

The arrangement of the elements of the propulsion system as shown in FIG. 10 is characterized by the fact that it allows a vehicle to be operated in both directions of travel on a single track guideway (1) with two or more stations (9) (9') located along the length of the block, with the option of propelling the vehicle by means of two power propulsion units (3) (3') (i.e., a dual propulsion circuit), either simultaneously or individually, with both ends of the propulsion duct being closed, with the power propulsion unit (3) being located at one end and with the other power propulsion unit being located near the other end, such that while one power propulsion unit (3') is generating positive air pressure in order to push the vehicle, the other power propulsion unit can generate negative air pressure.

The elements of the propulsion system involved in the operation of the system include the propulsion duct formed by the guideway (1), two power propulsion units (3) (3'), and two plugs (8) (8') located at the end of the duct, so as to form a safety circuit at each end of the line.

With the vehicle stopped at one station (9), in order to move the vehicle to another station (9'), the atmospheric valves (2) (2') are placed in the closed position, and the airflow control valves of the power propulsion unit (3) are positioned such that this power propulsion unit provides a flow of air under the positive pressure regime, while the control valves connected to the other power propulsion unit (3') are positioned such that this power propulsion unit (3') provides a flow of air under the negative pressure regime. The positive air pressure acting on one side of the vehicle propulsion plate and the negative air pressure in the duct, acting on the other side of the vehicle propulsion plate, together create thrust that is equal to the sum of the positive and negative air pressures generated by the respective power propulsion units (3) (3') acting on the surface of the propulsion plate. The resulting thrust acting on the vehicle propulsion plate causes the vehicle to accelerate and move away from the station (9) toward the other station (9'). While the vehicle is in motion, either of the two power propulsion units (3) (3') may stop providing positive or negative air pressure, so that only one power propulsion unit continues to propel the vehicle, as long as the necessary propulsion thrust is reduced. In such a case, the power propulsion unit that is not providing a propulsive airflow will keep its control valves positioned so as not to provide any airflow at all, while at the same time still allowing the airflow to pass from the interior of the duct (1) out to the atmosphere.

Figure 11:
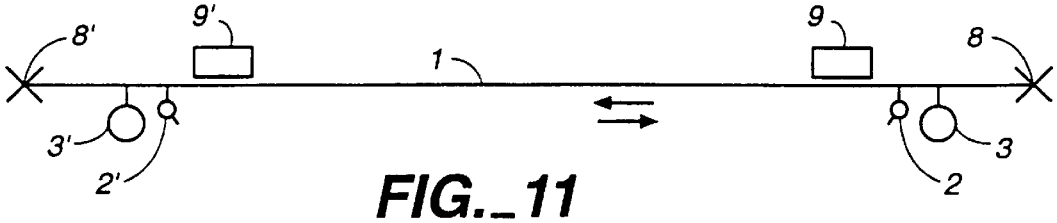

The arrangement of the elements of the propulsion system as shown in FIG. 11 is characterized by the fact that it allows a vehicle to be operated in both directions of travel on a single track guideway (1) with two or more stations (9) (9') located along the length of the block, with the option of propelling the vehicle by means of two power propulsion units (3) (3') (i.e., a dual propulsion circuit), either simultaneously or individually. This arrangement differs from the preceding one because of the addition of two atmospheric valves (2) (2') located between the terminal stations (9) (9') and each power propulsion unit (3) (3'), such that when only one power propulsion unit is necessary to propel the vehicle, the other power propulsion unit can be deactivated and its control valves can be kept closed, because the atmospheric valve on the side opposite the power propulsion unit in service would be placed in the open position to allow the air to be discharged. When it is necessary to decelerate the vehicle, the atmospheric valve can be closed in order to cut off the airflow in the duct and thus to stop the vehicle.

The elements of the propulsion system involved in the operation of the system include the main propulsion duct (1), two power propulsion units (3) (3'), two atmospheric valves (2) (2'), and two plugs (8) (8') located at the ends of the duct, each of which, in conjunction with an additional guideway section, forms a safety circuit at each end of the line.

With the vehicle stopped at one station (9), in order to move the vehicle to another station (9'), the atmospheric valves (2) (2') are placed in the closed position, and the airflow control valves of the power propulsion unit (3) located ahead of the departure station (9) are positioned such that this power propulsion unit provides a flow of air under the positive pressure regime. The airflow control valves in the other power propulsion unit (3'), located after the destination station (9'), are positioned such that this power propulsion unit (3') provides a flow of air under the negative pressure regime. In order to move the vehicle in the opposite direction, i.e., from the station (9') to the station (9), the cycle is repeated, because the arrangement of the elements of the propulsion system is symmetrical in relation to the length of the line.

Figure 12:
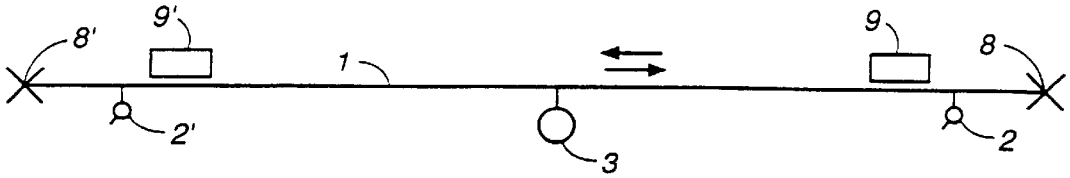

The arrangement of the elements of the propulsion system as shown in FIG. 12 is characterized by the fact that it allows a vehicle to be operated in both directions of travel on a single track guideway (1) with two or more stations (9) (9') located along the length of the block, with one power propulsion unit (3) being located in the area in the middle of the overall length of the block. The power propulsion unit (3) sometimes generates positive air pressure in the duct and sometimes generates negative air pressure in the duct, in order to operate the vehicle in one direction or the other. The propulsion duct is closed at both ends, with plugs (8) (8') located at the end of the duct, and an atmospheric valve (2) (2') is installed between the terminal stations and each end of the duct. When the vehicle is being operated in the block, the atmospheric valve located on the same side on which the vehicle is being pulled or pushed by the column of air in the duct is placed in the position in which it is open to the atmosphere, in order to allow air to enter or exit through the.valve, while the other atmospheric valve is kept in the closed position until the vehicle enters the block between this valve and the power propulsion unit (3), at which point the valve that was initially open is closed. In order to decelerate the vehicle, the atmospheric valve toward which the vehicle is moving can be closed in order to cut off the airflow in the propulsion duct.

The elements of the propulsion system involved in the operation of the system include the propulsion duct formed by the guideway (1), a power propulsion unit (3), two atmospheric valves (2) (2'), and two plugs (8) (8') located at the end of the duct, each of which, in conjunction with an additional section of the propulsion duct, forms a safety circuit at each end of the line.

With the vehicle stopped at the departure station (9), the atmospheric valve (2) located ahead of this station (9) is placed in the open position so as to allow the entry of an airflow from the atmosphere into the interior of the duct (1). The control valves of the power propulsion unit (3) are positioned such that the power propulsion unit (3) provides a flow of air under the negative pressure regime. The atmospheric valve (2') located after the destination station (9') is closed, so that the negative air pressure generated by the power propulsion unit (3) acts on the vehicle propulsion plate in such a way as to cause thrust that accelerates the vehicle, which therefore moves from the departure station toward the destination station (9'). The power propulsion unit (3) pulls the vehicle in its direction, as a result of the airflow under the negative pressure regime. When the vehicle in motion is close to the position of the power propulsion unit (3), this power propulsion unit momentarily places its flow control valves in the closed position, and as soon as the vehicle has passed the position of the power propulsion unit on the line (1), this power propulsion unit places its flow control valves in such a position that the power propulsion unit shifts to generating an airflow under the positive pressure regime. At the same time, the atmospheric valve (2), which had been open, closes, while the atmospheric valve (2'), which initially had been closed, shifts to the open position. This valve configuration is maintained until the vehicle starts to decelerate in order to stop, at which point the valves in the power propulsion unit (3) are closed in order to cut off the propulsive airflow. This arrangement of the elements of the propulsion system is symmetrical in relation to the length of the line (1), and the operation of the vehicle in the other direction is accomplished in accordance with the same cycle.

Figure 13:
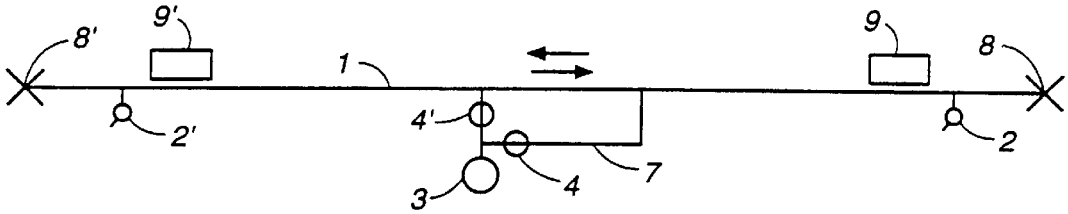

The arrangement of the elements of the propulsion system, as shown in FIG. 13 is characterized by the fact that it allows a vehicle to be operated in both directions of travel on a single track guideway (1) with two or more stations (9) (9') located along the length of the block, with one power propulsion unit (3) being located in the area in the middle of the overall length of the block. The power propulsion unit (3) sometimes generates positive air pressure in the duct and sometimes generates negative air pressure in the duct, in order to operate the vehicle in one direction or the other. The power propulsion unit (3) is connected to the guideway duct (1) by means of a secondary propulsion circuit that consists of a secondary duct (7) and two flow control valves (4) (4'). The secondary propulsion circuit allows the vehicle to be moved when it has inadvertently stopped with the propulsion plate in the position in which the power propulsion unit provides the airflow for the line duct (1). The propulsion duct is closed at its ends by plugs (8) (8') located at the end of the duct, and an atmospheric valve (2) (2') is installed between the terminal stations (9) (9') and each end of the duct.

The elements of the propulsion system involved in the operation of the system include the propulsion duct formed by the guideway (1), a power propulsion unit (3), a secondary propulsion circuit with a secondary duct (7) and two airflow control valves (4) (4'), two atmospheric valves (2) and two plugs (8) (8') located at the ends of the duct.

With the vehicle stopped at the departure station (9), the atmospheric valve (2) located ahead of this station (9) is placed in the open position so as to allow the entry of air from the atmosphere into the duct (1). The flow control valves of the power propulsion unit (3) are positioned such that the power propulsion unit provides a flow of air under the negative air pressure regime. The atmospheric valve (2') located after the destination station (9') is closed, so that the negative air pressure generated by the power propulsion unit acts on the vehicle propulsion plate in such a way as to cause thrust that accelerates the vehicle, which therefore moves from the departure station toward the destination station (9'). The power propulsion unit (3) pulls the vehicle in its direction, as a result of the airflow under the negative pressure regime. When the vehicle in motion is close to the position of the power propulsion unit (3), this power propulsion unit momentarily places its flow control valves in the closed position, and as soon as the vehicle has passed the location of the power propulsion unit on the guideway, this power propulsion unit places its flow control valves in a position such that the power propulsion unit shifts to generating an airflow under the positive pressure regime. At the same time, the atmospheric valve (2), which had been open, closes, while the atmospheric valve (2'), which initially had been closed, shifts to the open position. This valve configuration is maintained until the vehicle starts to decelerating in order to stop, at which point the valves in the power propulsion unit are closed in order to cut off the propulsive airflow. The airflow control valve (4') in the secondary propulsion circuit normally stays open, and the airflow control valve (4) stays closed. If necessary, the flow control valves in the secondary circuit are alternately closed or open, so as to direct the airflow generated by the power propulsion unit (3) toward one side or the other of the vehicle propulsion plate located in the secondary propulsion circuit. This arrangement of the elements of the propulsion system is symmetrical in relation to the length of the line (1), and the operation of the vehicle in the other direction is accomplished in accordance with the same cycle.

Figure 14:
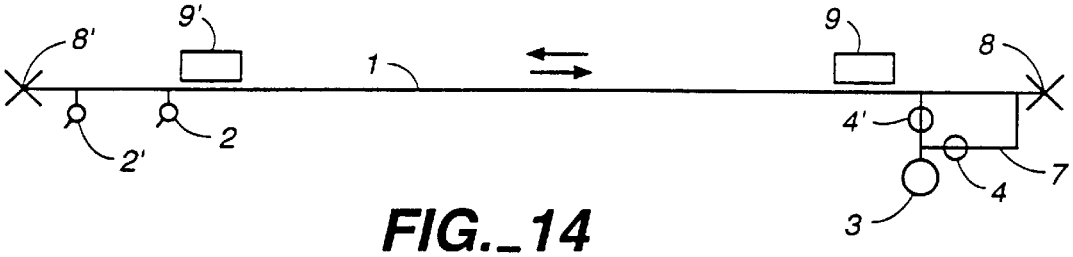

The arrangement of the elements of the propulsion system as shown in FIG. 14 is characterized by the fact that it allows the consecutive operation of two vehicles in both directions of travel on a single guideway (1) with two or more stations (9) (9') located along the length of the block, with the second vehicle leaving after the first vehicle has reached the terminal station. The power propulsion unit (3) is located at one of the ends, between the end of the guideway (1) and the first passenger station (9), and this power propulsion unit (3) sometimes generates positive air pressure in the duct and sometimes generates negative air pressure in the duct, in order to operate the vehicle in one direction or the other. The propulsion duct is closed at its ends by means of plugs (8) (8') which, in conjunction with an additional guideway duct segment form a safety circuit located at each end of the line. The airflow circuit is controlled by means of two atmospheric valves (2) (2'), installed at different positions between one terminal station and the end of the line (1), and in the other station by means of the power propulsion unit (3), which is connected to the guideway duct (1) by means of a secondary propulsion circuit that includes a secondary duct and two control valves (4) (4'). This set of elements makes it possible for a vehicle to be able to move from one station (9) to another (9') and, shortly afterward, for a second vehicle to make the same trip, inasmuch as, on one side of the line, the secondary duct (7) supplies the airflow in front of or behind the first vehicle or the second vehicle, and, at the other end of the line, one or the other of the two installed atmospheric valves opens in such a way as to select the airflow circuit to propel the first or the second vehicle.

The elements of the propulsion system involved in the operation of the system include the propulsion duct formed by the line (1), a power propulsion unit (3) connected to the guideway duct by means of a secondary propulsion circuit consisting of a secondary duct (7) and two flow control valves (4) (4'), two atmospheric valves (2) (2'), and two plugs (8) (8') located at the ends of the duct, in addition to the respective safety circuits.

Starting with the vehicles at the station (9), one of the vehicles is located outside the secondary propulsion circuit and the other is located within the stretch of guideway consisting of the secondary propulsion circuit. The control valves (4) (4') in the power propulsion unit are positioned such that the power propulsion unit provides an airflow under the positive pressure regime. In the secondary propulsion circuit, the valve (4') is open, while the valve (4) is kept closed. The atmospheric valve (2') is open and the atmospheric valve (2) is closed. This valve configuration allows the first vehicle to be propelled from the departure station (9) to the destination station (9'), with this vehicle, when it reaches the station (9'), being positioned between the location of the atmospheric valves (2) (2').

After the first vehicle has reached the destination station (9') and has taken up its position between the atmospheric valves (2) (2'), the flow control valves in the power propulsion unit (3) are once again positioned in such a way that the power propulsion unit provides an airflow under the positive pressure regime. In the secondary propulsion circuit, the valve (4') is closed, and the valve (4) is opened. The atmospheric valve (2') is closed, while the atmospheric valve (2) is opened. With this valve configuration, the second vehicle, which is located in the zone consisting of the secondary propulsion circuit, is propelled from the departure station (9) to the destination station (9'). When the vehicle begins its deceleration, the control valves coupled to the power propulsion unit (3) are closed in order to cut off the propulsive airflow. The fact that the atmospheric valve (2') is closed and the guideway propulsion duct (1) is closed at the end, precludes the existence of a propulsive airflow acting on the first vehicle, which is stopped at the station (9'). For the sake of convenience with regard to the two vehicles standing in front of the station (9'), the boarding platform of this station can be extended from ahead of the location of the atmospheric valve (2) to the location of the atmospheric valve (2').

When the two vehicles are operated in the opposite direction, that is, from the station (9') to the station (9), the cycle is repeated, but the control valves coupled to the power propulsion unit (3) are positioned such that the flow is generated under the negative air pressure regime instead of under the positive air pressure regime. The vehicles are then operated toward the initial originating positions at the station (9).

Figure 15:
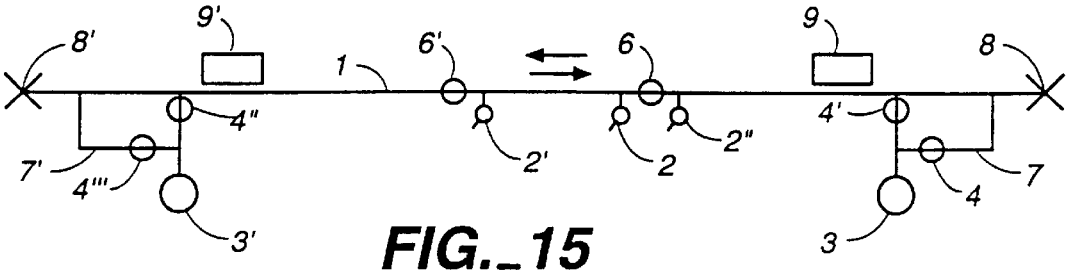

The arrangement of the elements of the propulsion system as shown in FIG. 15 is characterized by the fact that it allows the simultaneous operation of two vehicles consecutively in both directions of travel on a single track guideway (1) with two boarding or loading and unloading stations (9) (9'), with one vehicle being able to depart from an initial terminal station and, after this vehicle has passed through an isolation circuit located along the length of the line, a second vehicle being able to depart from the same originating station. Each power propulsion unit (3) is connected by means of a secondary propulsion circuit that consists of a secondary duct (7) and two control valves (4) (4'). Between each terminal station and the end of the line, the power propulsion units (3) (3') sometimes generate positive air pressure in the duct and sometimes generate negative air pressure in the duct, in order to operate the vehicle in one direction or the other. The propulsion duct is closed at both of its ends by means of plugs (8) (8') which, in conjunction with an additional stretch of the line duct, form a safety circuit at each end of the line (1). The isolation circuit located along the length of the block of the line between the stations consists of two appropriately spaced section isolation valves (6) (6') and two atmospheric valves. This isolation circuit is located at an appropriate point along the length of the block, compatible with the time schedules for the simultaneous operation of the two vehicles in the blocks before and after this isolation circuit. This arrangement allows both of the vehicles. to travel between the two terminal stations. However, neither of the two vehicles can begin its return trip until both of the vehicles have reached the destination station.

The elements of the propulsion system involved in the operation of the system include the propulsion duct formed by the guideway (1), two power propulsion units (3) (3'), each of which is connected to the line duct by means of a secondary propulsion circuit with a secondary duct (7) (7') and two flow control valves (4) (4') in each duct, two section isolation valves (6) (6'), and atmospheric valves (2) (2'), forming a isolation circuit; and two plugs (8) (8') located at the ends of the duct, each of which plugs is connected to an additional extension of the line duct, so as to form a safety circuit at each end of the line. An atmospheric valve (2") allows a vehicle to operate ahead of the isolation circuit formed by the valves (6) (2) (2'), while the other vehicle operates behind the isolation circuit.

The isolation circuit separates the two blocks of the guideway adjacent to it, in such as way that a vehicle in operation is kept under propulsion, in motion, and all of the valves in the isolation circuit are operated safely, when the vehicle and its propulsion plate are far enough away from any of the section isolation valves and without any action by positive or negative propulsive air pressure on these valves when the valves are changing their position from closed to open or vice versa.

At first, both of the vehicles are at the station (9), with one of the vehicles being located outside the secondary propulsion circuit and the other located within the stretch of guideway constituted by the secondary propulsion circuit. The control valves in the power propulsion unit (3) are positioned such that the power propulsion unit provides an airflow under the positive pressure regime. In the secondary propulsion circuit, the valve (4') is open, while the valve (4) is kept closed. This configuration for the secondary propulsion circuit allows the propulsion of the first vehicle alone, directing the airflow generated by the power propulsion unit to a position ahead of the propulsion plate of the first vehicle that will be departing and behind the propulsion plate of the second vehicle. The atmospheric valve (2') is open and the section isolation valve (6') is closed, thereby limiting to this position on the line (1) the propulsion circuit of the first vehicle that will be departing. The section isolation valve (6') is open and the atmospheric valves (2) (2') are closed, thereby creating conditions of continuity for the propulsion duct in this guideway position. With this valve configuration, the first vehicle is propelled by the power propulsion unit (3) and placed in motion departing from the station (9).

As long as no vehicle enters the block consisting of the isolation circuit, the power propulsion unit (3') and the associated secondary propulsion circuit remain with all valves closed. When the first vehicle enters the guideway section consisting of the isolation circuit formed by the valves (6) (2) (2') (6'), this vehicle stops being propelled by the power propulsion unit (3) and shifts to being propelled by the power propulsion unit (3'). For this purpose, the following valve configuration is implemented: The atmospheric valve (2) is open and the section isolation valve (6) is closed; the section isolation valve (6') is open and the atmospheric valve (2') is closed; and the flow control valves in the power propulsion unit (3') are positioned so that an airflow under the negative air pressure regime is provided in order to pull the vehicle. In the isolation circuit, the flow control valve (4") is open and the flow control valve (4'") is closed. The first vehicle then shifts to being propelled by the power propulsion unit (3'), and the propulsion circuit is delimited between the position of this power propulsion unit (3') and the position of the atmospheric valve (2). This valve configuration is maintained while the vehicle is in the block consisting of the isolation circuit formed by the valves (2) (2') (6) (6'). After the first vehicle has exited the isolation circuit, i.e., passed beyond the position of the section isolation valve (6'), the following valve configuration is assumed so that the first vehicle can reach the station (9') and the second vehicle leaves the station (9).

The power propulsion unit (3) continues with the flow control valves positioned so as to provide an airflow under a positive air pressure regime. In the secondary propulsion circuit, the valve (4') is closed and the valve (4) is opened, thereby directing the airflow provided by the power propulsion unit (3) toward the anterior portion of the propulsion plate of the second vehicle, in order to push that vehicle.

The atmospheric valve (2") is used only if the first vehicle is in the guideway section consisting of the isolation circuit and the second vehicle is simultaneously departing from the station (9). In this case, the atmospheric valve (2") is open to allow the discharge of the airflow from the duct in the circuit between this atmospheric valve (i.e., the second vehicle) and the station (9), the atmospheric valve keeping this position while the first vehicle has not yet left from the secondary propulsion circuit.

When the first vehicle is close to the station (9') in the secondary propulsion circuit, the flow control valve (4'") opens and the valve (4") closes, so that the power propulsion unit (3') can pull the vehicle toward it, positioning it in the segment of the guideway consisting of the secondary propulsion circuit.

In order for the second vehicle to be displaced until it reaches the station (9'), the power propulsion unit (3) can continue to provide the airflow under the positive air pressure regime, as soon as the valves in the propulsion unit (3') are positioned so that the latter does not provide an airflow, but connects the guideway duct to the atmosphere. In this case, the section isolation valves (6) (6') are open and the atmospheric valves (2) (2') (2") are closed.

If the power propulsion unit (3') is used to pull the second vehicle to the station (9'), after the vehicle has passed through the isolation circuit, the section isolation valve (6) is kept closed, the atmospheric valve (2) is opened, the section isolation valve (6') is opened, and the atmospheric valve (2') is closed. The control valves in the power propulsion unit (3) are closed in order to cut off the airflow supply. In order to pull the second vehicle, the flow control valves in the power propulsion unit (3') are kept in the proper positions to generate an airflow under the negative air pressure regime, in the same way as done earlier to pull the first vehicle. However, the airflow is connected ahead of the first vehicle, which has already stopped at the station, i.e., to the secondary propulsion circuit, with the flow control valve (4'") being closed and the valve (4") being open. With this valve configuration the propulsion circuit for pulling the vehicle to the station (9') is defined as consisting in the guideway section enclosing the atmospheric valve (2) and the power propulsion unit connected to the guideway duct by means of the secondary propulsion circuit.

When the vehicles start to decelerate, the control valves connected to the respective power propulsion unit are closed in order to cut off the propulsive airflow.

The closure of the guideway propulsion duct at each end by means of a safety circuit entails the absence of a propulsive airflow acting, on the first vehicle, which is stopped at the station (9). For the sake of convenience with regard to the two vehicles standing in front of the station (9'), the boarding platform of this station can be extended along the length of the secondary propulsion circuit, plus any extension that may be necessary in order to allow the second vehicle to stop.

When the two vehicles are operated in the opposite direction, i.e., from the station (9') to the station (9), the cycle is repeated, because the arrangement of the propulsion elements is symmetrical in relation to the guideway length.

Figure 16:
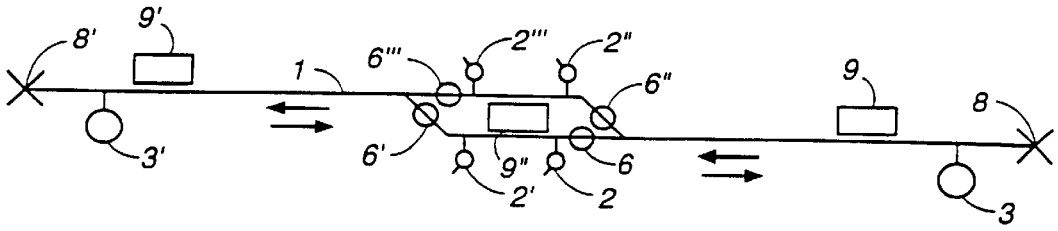

The arrangement of the elements of the propulsion system as shown in FIG. 16 is characterized by the fact that it allows the simultaneous operation of two vehicles in opposite directions on a single track guideway with three stations, each of which vehicle has its own guideway segment in the central station and continues its travel toward its respective destination station.

The elements of the propulsion system involved in the operation of the vehicles described below include the propulsion duct formed by the guideway (1), two power propulsion units (3) (3'), two atmospheric valves (2") (2'") and two section isolation valves (6") (6'"), forming an isolation circuit, two atmospheric valves (2) (2'), and two section isolation valves (6) (6') forming another isolation circuit, and two plugs (8) (8') located at the ends of the duct, each of which plug is connected to an additional extension of the guideway duct, so as to form a safety circuit at each end of the line.

One vehicle departs from the station (9) and the other vehicle departs from the station (9'), with each vehicle operating in its own block, as defined by an independent propulsion circuit. A propulsion circuit is defined by the block included between the power propulsion unit (3') and the atmospheric valve (2") Another propulsion circuit is defined by the block included between the power propulsion unit (3) and the atmospheric valve (2').

To operate the vehicle that departs from the station (9') the airflow control valves connected to the power propulsion unit (3') are positioned such that an airflow is provided under the positive air pressure regime. The section isolation valve (6'")is open, the atmospheric valve (2'") is closed, the atmospheric valve (2") is open, and the section isolation valve (6") is closed. The power propulsion unit (3') provides an airflow under the positive air pressure regime, which airflow acts on the propulsion plate of the vehicle in such a way as to move the vehicle. The atmospheric valve (2") which is in the open position, allows the discharge of the airflow generated by the power propulsion unit (3')

To operate the vehicle that departs from the station (9'), the airflow control valves connected to the power propulsion unit (3) are positioned such that an airflow is provided under the positive air pressure regime. The section isolation valve (6) is open, the atmospheric valve (2) is closed, the atmospheric valve (2') is open, and the section isolation valve (6') is closed. The power propulsion unit (3) provides an airflow under the positive air pressure regime, which airflow acts on the propulsion plate of the vehicle in such a way as to move the vehicle. The atmospheric valve (2'), which is in the open position, allows the discharge of the airflow generated by the power propulsion unit (3).

Each vehicle. travels to the station (9"), and then continues on its route toward each of the stations to which it is directed along the length of the line. When the vehicles reach the station (9"), the valves in the isolation circuits associated with this station are repositioned so that the vehicles can continue their journey.

In order for the vehicle that is travelling from the station (9') to continue its trip from the station (9"), the propulsion circuit previously occupied by the vehicle that is travelling from the station (9) is utilized. For this purpose, the flow control valves connected to the power propulsion unit (3) are positioned in such a way that an airflow is provided under the negative air pressure regime. The section isolation valve (6) is closed; the section isolation valve (6") is open; the atmospheric valve (2) is open, and the atmospheric valve (2") is closed. The vehicle is pulled by the negative pressure of the airflow generated by the power propulsion unit (3), whose air into the line duct is accomplished by means of the atmospheric valve (2), which is open.

In order for the vehicle that is travelling from the station (9), to continue its trip from the station (9'), the propulsion circuit previously occupied by the vehicle that is travelling from the station (9') is utilized. For this purpose, the flow control valves connected to the power propulsion unit (3') are positioned in such a way that an airflow is provided under the negative air pressure regime. The section isolation valve (6) is closed; the section isolation valve (6') is open; the atmospheric valve (2) is open and the atmospheric valve (2') is closed. The vehicle is pulled by the negative pressure of the air generated by the power propulsion unit (3'), whose input of air into the line duct is accomplished by means of the atmospheric valve (2), which is open.

During the deceleration stage for the vehicles, the flow control valves connected to the respective power propulsion units used to operate the vehicles are closed in order to cut off the propulsive airflow, or else modulated between open and closed, in proportion to the extent to which propulsive power is required.

Figure 17:
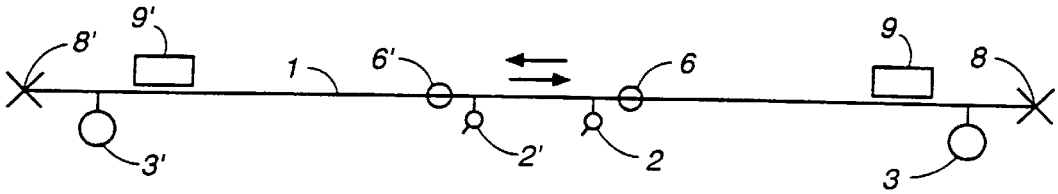

The arrangement of the elements of the propulsion system as shown in FIG. 17 is characterized by the fact that it allows the operation of two vehicles in both directions of travel on a single track guideway with two or more stations located along the length of the block, with a power propulsion unit being located at each end, between the end of the line and the passenger station. Each power propulsion unit sometimes generates positive air pressure in the duct and sometimes generates negative air pressure in the duct, in order to propel the vehicle in one direction or the other. An isolation circuit consisting of two atmospheric valves and two section isolation valves, located at a given point along the length of the line, isolates the sub-block in which the vehicle is located, in such a way that in this segment, a posterior power propulsion unit generates positive air pressure, pushing the vehicle to the isolation block, after which the other power propulsion unit, which is located after the destination station, generates negative air pressure, pulling the vehicle toward its destination station.

This arrangement of the elements of the propulsion system allows better propulsion performance to be obtained in long blocks, in which losses due to air leakage into the system and hard losses of the airflow in the duct start to become severe, in proportion to the length of the guideway propulsion duct. The block consisting of the isolation circuit allows the inclusion of a passenger station without in any way affecting the operation of the propulsion arrangement, except that the vehicle stops in the station and then resumes its journey.

The elements of the propulsion system involved in the operation of the system include the propulsion duct formed by the guideway (1), two power propulsion units (3) (3'), two atmospheric valves (2) (2'), two section isolation valves (6) (6'), and two plugs (8) (8') located at the ends of the duct, each of which plugs is connected to an additional extension of the guideway duct, so as to form a safety circuit at each end of the line.

When the vehicle leaves the station (9), the flow control valves in the power propulsion unit (3) are positioned so that the power propulsion unit provides an airflow under the positive air pressure regime. The section isolation valve (6') is closed, and the atmospheric valve (2') is open to allow the discharge of the airflow. The section isolation valve (6) is open, and the atmospheric valve (2) is closed. The vehicle is propelled until it enters the block of the line consisting of the isolation circuit, i.e., until it is located between the assembly formed by the section isolation valve (6) and the atmospheric valve (2), and the assembly formed by the section isolation valve (6') and the atmospheric valve (2'). When the vehicle enters the block consisting of the isolation circuit, the vehicle ceases to be propelled by the power propulsion unit (3) and shifts to being propelled by the power propulsion unit (3'). Therefore, the flow control valves in the power propulsion unit (3) are closed, the flow control valves in the power propulsion unit (3') are positioned in such a way that an airflow is provided under the negative air pressure regime (i.e., suction), and the valves in the isolation circuit are positioned in the following way: First, the section isolation valve (6') is opened; then the atmospheric valve (2) is opened, next, the atmospheric valve (2') is closed; and finally the section isolation valve (6) is closed. The vehicle is then propelled until it reaches the destination station (9').

An extension consisting of the isolation circuit is determined and provided, on the basis of the speed of the vehicle and the time required safely to operate the section isolation valves and the atmospheric valves so that the vehicle does not need to reduce its speed or even to stop during its travel from the station (9) to the station (9'). Because the arrangement of the elements of the propulsion elements is symmetrical in throughout the guideway length, the operation of the two vehicles in the opposite direction is consistent with the same type of cycle.

Figure 18:
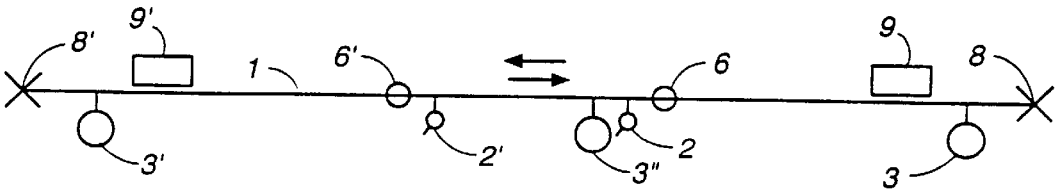

The arrangement of the elements of the propulsion system as shown in FIG. 18 is characterized by the fact that it allows the operation of a vehicle in both directions of travel on a single track guideway with two or more stations located along the length of the block, with three power propulsion units, one of which is located at each end, between the end of the line and the passenger station, plus one located in the block consisting of an isolation circuit positioned along the route.

Each power propulsion unit sometimes generates positive air pressure in the duct and sometimes generates negative air pressure in the duct, in order to propel the vehicle in one direction or the other. The isolation circuit consists of two atmospheric valves and two section isolation valves, located at a given point along the length of the line, isolating the sub-block in which the vehicle is located, in such a way that in this segment, a posterior power propulsion unit generates positive air pressure, pushing the vehicle to the isolation block, after which the other power propulsion unit, which is located behind the destination station, generates negative air pressure, pulling the vehicle toward its destination station.

The power propulsion unit located in the block of the line consisting of the isolation circuit, when in simultaneous operation with one of the other power propulsion units, constitutes a dual propulsion circuit, with the vehicle en route in the block in front of or behind the isolation circuit.

This arrangement of the elements of the propulsion system allows better propulsion performance to be obtained in long guideway sections, in which losses due to leakage into the system and hard losses of the airflow in the duct start to become severe, in proportion to the length of the guideway propulsion duct, and when it is necessary to use a dual propulsion circuit in order to achieve the level of performance required for the vehicle.

The block consisting of the isolation circuit allows the inclusion of a passenger station without in any way affecting the operation of the propulsion arrangement, except that the vehicle stops at the station and then resumes its journey.

This propulsion arrangement differs from the preceding one in that it includes a power propulsion unit in the guideway block consisting of the isolation circuit, thereby allowing the vehicle to be propelled, either under the negative pressure regime or under the positive pressure regime, by two power propulsion units that form a dual propulsion circuit, thereby offering the capability of doubling the intensity of the thrust, particularly during the vehicle's acceleration phase.

The elements of the propulsion system involved in the operation of the system include the propulsion duct formed by the guideway (1), three power propulsion units (3) (3') (3"), two atmospheric valves (2) (2'), two section isolation valves (6) (6'), and two plugs (8) (8') located at the ends of the duct, each of which plugs is connected to an additional extension of the guideway duct, so as to form a safety circuit at each end of the line.

When the vehicle leaves the station (9), the flow control valves in the power propulsion unit (3) are positioned such that the power propulsion unit provides an airflow under the positive air pressure regime. The section isolation valve (6') is closed and the atmospheric valve (2') is closed. The section isolation valve (6) is open and the atmospheric valve (2) is closed. The airflow control valves in the power propulsion unit (3") are positioned such that this power propulsion unit provides an airflow under the negative air pressure regime, so as to form, in conjunction with the power propulsion unit (3), a dual propulsion circuit.

The vehicle is propelled until it enters the guideway section consisting of the isolation circuit, i.e., until it is located between the set formed by the section isolation valve (6) and the atmospheric valve (2), and the set formed by the section isolation valve (6') and the atmospheric valve (2'). When the vehicle enters the block consisting of the isolation circuit, the vehicle ceases to be propelled by the power propulsion unit (3) (3"), and shifts to being propelled by the power propulsion unit (3'). Therefore, the flow control valves in the power propulsion unit (3) are closed, the flow control valves in the power propulsion unit (3') are positioned in such a way that an airflow is provided under the negative air pressure regime (i.e., suction), and the valves in the isolation circuit are positioned in the following way: First, the section isolation valve (6') is opened; then the atmospheric valve (2) is opened; next, the atmospheric valve (2') is closed; and finally the section isolation valve (6) is closed. After the vehicle exits the isolation circuit, i.e., after it passes the location of the section isolation valve (6'), the atmospheric valve (2) is closed, and the valves in the power propulsion unit (3") are positioned such that an airflow is provided under the positive air pressure regime, so as to form, in conjunction with the power propulsion unit (3'), a dual propulsion circuit.

The vehicle is then propelled until it reaches the destination station (9'). An extension consisting of the isolation circuit is determined and provided, on the basis of the speed of the vehicle and the time required safely to operate the section isolation valves and the atmospheric valves so that the vehicle does not need to reduce its speed or even to stop during its travel from the station (9) to the station (9'). Because the arrangement of the elements of the propulsion elements is symmetrical throughout the length of the line, the operation of the two vehicles in the opposite direction, from station (9') to station (9), is consistent with the same type of cycle.

Figure 19:
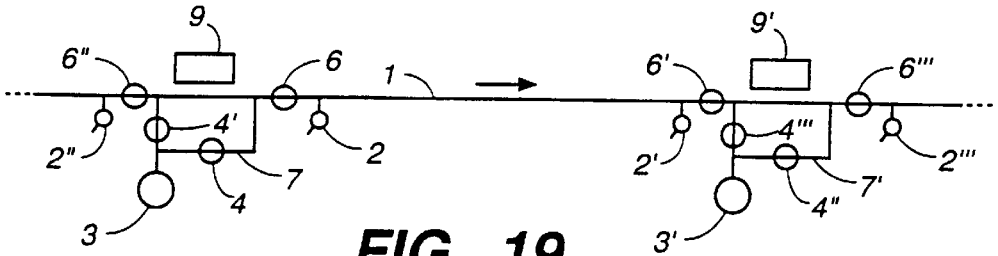

The arrangement of the elements of the propulsion system as shown in FIG. 19 allows vehicles to operate in a single direction of travel, on a line with as many stations as necessary, with the option of operating all of the vehicles simultaneously, each in its own respective block between two consecutive stations. This arrangement adds a secondary propulsion circuit that connects each power propulsion unit to the main guideway duct, thereby allowing each vehicle to be handled in the region of the boarding or loading platform in the station.

This arrangement is appropriate for dual guideway lines, with independent guideways for simultaneous trips of vehicles on both directions within a transportation network.

In each station, at guideway positions located immediately in front of and behind the boarding or loading platforms, a secondary propulsion circuit is connected consisting of a secondary duct (7) and two airflow control valves (4) (4'), in the case of a station (9) to whose secondary propulsion circuit a power propulsion unit (3) is connected. In accordance with the direction of travel of the vehicle on the line, from the station (9) to the station (9'), after the station (9) boarding or loading platform, a section isolation valve (6) is installed, followed by an atmospheric valve (2). Before the station boarding or loading platform, a section isolation valve (6") is installed, along with an atmospheric valve (2") in front of this section isolation valve (6").

When a vehicle is en route from one station (9) to the next station (9'), the airflow control valves in the power propulsion unit (3) are positioned such that an airflow is provided under the positive air. pressure regime. In the secondary propulsion circuit (7), the airflow control valve (4') is open and the airflow control valve (4) is closed, so as to direct the airflow onto the anterior portion of the vehicle propulsion plate and consequently to push the vehicle. The section isolation valve (6") installed before the boarding or loading platform of the station (9) is closed, isolating the power propulsion unit (3) from the guideway duct, ahead of the station (9). The atmospheric valve (2") installed ahead of the boarding or loading platform in the station (9) is open to allow the discharge of the airflow in the duct into the guideway section ahead of the station (9). The section isolation valve (6), located behind the platform of the station (9), is open, linking the power propulsion unit (3) to the block behind the station (9), where the vehicle will enter. The atmospheric valve located behind the station platform, is closed so that the airflow in the duct will exit through the atmospheric valve (2'), located near the following station (9'), which is the destination of the vehicle.

With this configuration of valves, a vehicle departing from a station (9) is propelled by the power propulsion unit (3) under a positive air pressure regime, and is displaced in the direction of the next station (9'). The propulsive airflow, provided by the power propulsion unit (3), acts on the vehicle propulsion plate, and the continuity of the airflow in the duct is achieved by means of the next atmospheric valve (2') located ahead of the next station (9'), through which valve the airflow completes the airflow circuit, exiting from the guideway duct into the atmosphere.

The valves remain in this configuration until the vehicle reaches the next station (9'), or until the deceleration phase starts, at which time the valves take on the following positions: The atmospheric valve (2), located behind the platform of the station (9), is open; the section isolation valve (6), located behind the platform of the station (9), is closed; the atmospheric valve (2'), located ahead of the next station (9'), is closed; the section isolation valve (6'), located ahead of the platform of the next station (9'), is open; the flow control valves in the power propulsion unit (3') at the next station (9') are positioned such that an airflow is generated under the negative air pressure regime, so that the vehicle is pulled, if necessary. In the secondary propulsion circuit (7'), the flow control valve (4'") is closed and the flow control valve (4") is open, thereby linking the airflow generated by the power propulsion unit (3') in the position behind the boarding or loading platform of the station (9'), and making it possible to propel and manoeuvre the vehicle into position adjacent to the boarding or loading platform.

The assembly formed by an atmospheric valve and a section isolation valve, located ahead of and behind the station platform, forms an isolation circuit, which selects the action of the airflow generated by the power propulsion unit toward the guideway block after or before the station, depending on the position of the vehicle in the block.

This cycle of operations for the vehicle by means of this arrangement of the elements of the propulsion system is repeated in all of the blocks located between two consecutive stations. The position of all of the valves described above, depending on the position of the vehicle in the block between two consecutive stations, is repeated respectively in all of the blocks in a line in a transportation system.

Figure 20:
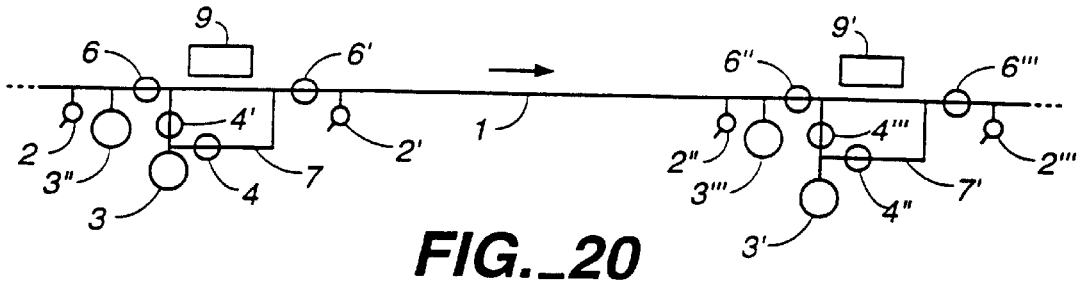

The arrangement of the elements of the propulsion system as shown in FIG. 20 allows vehicles to operate in a single direction of travel, on a line with as many stations as necessary, with the option of operating all of the vehicles simultaneously, each in its own respective block between two consecutive stations. This arrangement is appropriate for dual lines, with independent guideways for each travelling direction by vehicles in operation in the system within a transportation network.

This arrangement is characterized by the following facts:

As many vehicles can be operated simultaneously as there are blocks between stations, with one vehicle in each block;

The vehicles are propelled independently for operation in each block;

Each vehicle can be propelled by one or two power propulsion units. as necessary, with one power propulsion unit operating, under the positive air pressure regime and the other operating under the negative air pressure regime, so as to form a dual propulsion circuit; and An assembly consisting of a section isolation valve and an atmospheric valve, installed ahead of and after each station, forms an isolation circuit, thereby achieving the separation of the propulsion circuits ahead of and after each station.

The following description reflects the direction of travel of the vehicle on the guideway (1), as defined as being from the station (9) to the station (9').

The elements of the propulsion system involved in the operations include the propulsion duct formed by the guideway (1), and the following elements, which are located ahead of or after the boarding or loading platform of each station: The power propulsion units (3) (3') (3") (3'"), with each of the power propulsion units (3) (3') being connected to the guideway duct by means of a secondary propulsion circuit consisting of a secondary duct (7) (7'), respectively, linked to the guideway duct ahead of and after the station platform, and the airflow control valves (4) (4') (4") (4'"). The elements of the propulsion system involved in the operations also include four atmospheric valves (2) (2') (2") (2'") and four section isolation valves (6) (6') (6") (6'").

The flow control valves of the power propulsion unit (3) are positioned such that this group provides an airflow under the positive air pressure regime. When dual propulsion is used in the block, the flow control valves in the power propulsion unit (3') are positioned such that this unit generates an airflow under the negative air pressure regime, and the atmospheric valve (2") located ahead of the latter (unit) is closed. In the event that the use of dual propulsion in the block is not necessary, i.e., when a single propulsion circuit is used, the airflow control valves in the power propulsion unit (3) are kept closed, and the atmospheric valve (2") is opened to allow the airflow to exit from the duct.

The other valves installed in the block are positioned in the following way: The section isolation valve (6) is closed, isolating the block in question from the preceding block, and in the secondary propulsion circuit (7) the airflow control valve (4') is open and the airflow control valve (4) is closed. In this way the airflow generated by the power propulsion unit (3) is directed so as to act behind the propulsion plate of the vehicle departing from the station (9), i.e., to push it. The section isolation valve (6') is open in order to allow the vehicle to enter the guideway block consisting of the segment located between stations (9) (9'); the atmospheric valve (2') is closed; and the section isolation valve (6") is closed in order to isolate the block in question from the next block, in which another vehicle is present. The atmospheric valves and the section isolation valves, as well as the valves in the power propulsion units installed in the guideway duct ahead of the section isolation valve (6"), are located in positions that are equal, respectively, to the position of the block now being described for the operation of the vehicle in the next block.

This configuration of the elements of the propulsion system within a block is maintained until propulsion is no longer necessary, or until the vehicle enters the deceleration phase, or even until the vehicle is approaching the next station, ahead of the atmospheric valve (2"). If propulsion is still necessary, but not dual propulsion, then the power propulsion unit (3) continues to generate an airflow under the negative air pressure regime in order to pull the vehicle, while the power propulsion unit (3) stops providing an airflow under the positive air pressure regime, keeping its flow control valves closed in order to do so. Furthermore, the atmospheric valve (2') opens to allow air to enter the duct, and the section isolation valve (6') closes, isolating the current block from the preceding one, while at the same time allowing the vehicle from the preceding block to enter the area consisting of the boarding or loading platform of the station (9).

As the vehicle approaches the next station (9'), the section isolation valve (6''') closes. The flow control valves in the power propulsion unit (3") also close, and this unit stops pulling the vehicle. If propulsion is necessary, the power propulsion unit (3') starts to pull the vehicle. For this purpose, its flow control valves are positioned such that this unit provides an airflow under the negative air pressure regime. In order for the power propulsion unit to allow the vehicle to be manoeuvred in the area in front of the boarding or loading platform in the station (9'), in the associated secondary propulsion circuit the flow control valve (4''') closes and the flow control valve (4") opens. If there is no need for propulsion when the vehicle is approaching, and until the vehicle stops in the destination station (9'), the flow control valves in the power propulsion unit (3') are placed in the closed position or are positioned in such a way as to connect the guideway duct to the atmosphere, without, however, generating a propulsive airflow.

This description of the operation of the vehicle in a block between two consecutive stations also applies to all of the blocks designed for a line or for a network in a transportation system with a variety of stations or stops. The positions of the valves as a function of the position of the vehicle on the guideway and as a function of. the amount of propulsion necessary reflect, respectively, the same positions defined in the preceding description.

Figure 21:
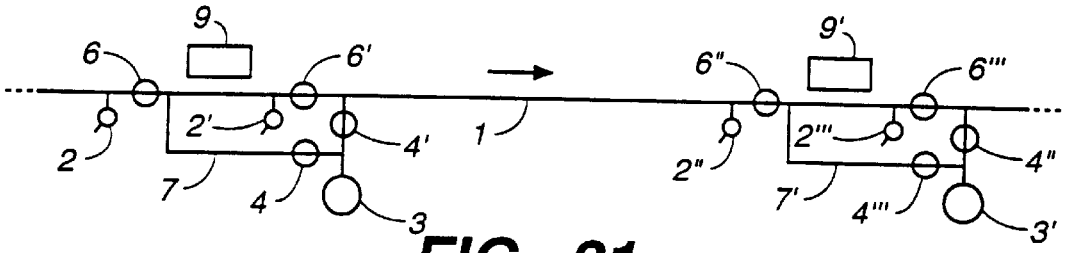

The arrangement of the elements of the propulsion system as shown in FIG. 21 allows vehicles to operate in one direction of travel, on a line with as many stations as necessary, with the option of operating all of the vehicles simultaneously, each in its own respective block between two consecutive stations. This arrangement is appropriate for dual lines, with independent guideways for each travelling direction by vehicles in operation in the system within a transportation network.

This arrangement provides the following options:

Simultaneous operation of as many vehicles as there are blocks between stations, with one vehicle in each block;

The vehicles can be propelled independently in operation in each block;

The vehicles can be propelled by power propulsion units located behind the boarding or loading platform in a station, generating airflow under the positive air pressure regime, so as to push the vehicle;

A secondary propulsion circuit equipped with a secondary duct and two coupled flow control valves allows the power propulsion unit that is installed behind the station platform to propel a vehicle when the vehicle is located in the extension of the guideway within the station; and An assembly consisting of a section isolation valve and an atmospheric valve, installed ahead of and after each station, isolates the blocks ahead of and after the station.

The elements of the propulsion system involved in the operation of a vehicle in the block between two consecutive stations include the propulsion duct formed by the guideway (1) and, associated with the originating station (9), the following elements, which are repeated respectively in connection with the other stations: A power propulsion unit (3), installed behind the station platform, connected to the guideway duct by means of a secondary propulsion circuit with a secondary duct (7) and two flow control valves (4) (4'); an assembly consisting of a section isolation valve and an atmospheric valve, installed ahead of and behind the station boarding or loading platform, with the blocks ahead of and behind the station, including the valves (2) (2') (6) (6'), serving to separate the propulsion circuits.

The operation of the vehicle reflects the travel direction defined as being from station (9) to station (9').

In order for a vehicle to begin a trip from a station (9), the flow control valves in the power propulsion unit (3) are positioned such that an airflow is provided under the positive air pressure regime. In the secondary propulsion circuit (7), the flow control valve (4') is closed and the flow control valve (4) is open, such that the airflow under the positive air pressure regime is directed in order to feed the guideway duct behind the vehicle and consequently pushing the vehicle. The section isolation valve (6) is closed, isolating the present circuit from the preceding block. The section isolation valve (6') is open in order to allow passage of the vehicle propulsion plate. The atmospheric valve (2') is closed. The section isolation valve (6") is closed in order to isolate the block in which the vehicle is located from the following block. The atmospheric valve (2") is open in order to allow the airflow to exit from the duct.

With this valve configuration, the vehicle is displaced from the station (9) toward the station (9'). After the vehicle passes the point at which the secondary duct in the secondary propulsion circuit is connected, which point is located immediately after the section isolation valve (6'), the flow control valve (4') in the secondary propulsion circuit is opened, and the flow control valve (4) is closed. Then the section isolation valve (6') is closed, the atmospheric valve (2') is opened, and the section isolation valve (6) is opened. With this new valve configuration, the vehicle continues to be propelled in the direction of the destination station (9'), but the preceding block is released in the region in front of the boarding or loading platform of the station (9) for the vehicle ingress coming from the preceding block. Similarly, in the current block, the valves on the station (9') toward which the vehicle is en route are respectively positioned such that the vehicle reaches the end of the block, i.e., the section isolation valve (6''') is closed, the atmospheric valve (2''') is open to allow the airflow to exit from the duct, the section isolation valve (6") is open, and the atmospheric valve (2") is closed.

When the vehicle enters the deceleration phase in order to stop at the station (9'), and if propulsive thrust is not necessary, then the control valves in the power propulsion unit (3) are closed or even positioned in such a way that the guideway duct is connected to the atmosphere, however without the provision of an airflow by the power propulsion unit.

This description of the operation of a vehicle in a block between two consecutive stations also applies to all of the blocks designed for a line or for a network in a transportation system with a variety of stations or stops. The positions of the valves as a function of the position of the vehicle on the guideway and as a function of the amount of propulsion necessary reflect, respectively, the same positions defined in the preceding description.

Figure 22:
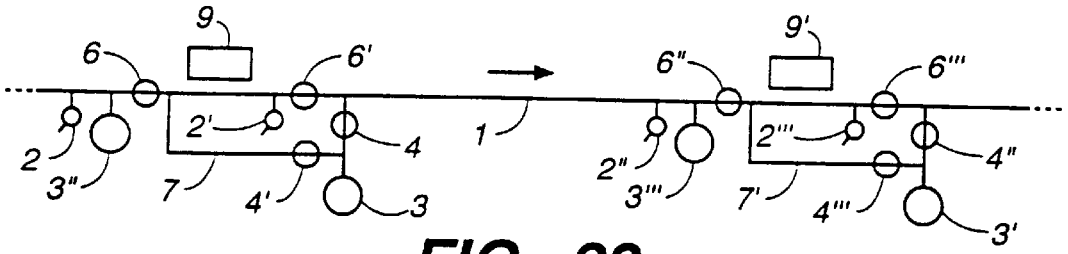

The arrangement of the elements of the propulsion system as shown in FIG. 22 allows vehicles to operate in one direction of travel, on a line with as many stations as necessary, with the option of operating all of the vehicles simultaneously, each in its own respective block between two consecutive stations. This arrangement is appropriate for dual guideway lines, with independent guideways for each direction of movement of the vehicles in operation in the system within a transportation network.

The configuration of this arrangement differs from the preceding one only in terms of the inclusion of a power propulsion unit ahead of the boarding or loading platform at each station, located between the atmospheric valve and the section isolation valve located in the same area, so as to form a dual propulsion circuit, i.e., with two power propulsion units per block, such that while one of these units exerts a positive air pressure, the other unit exerts a negative air pressure. In this way, the intensity of the thrust applied to the vehicle propulsion plate(s) can be doubled in order to satisfy loading and performance conditions.

This arrangement provides the following options:

Simultaneous operation of as many vehicles as there are blocks between stations, with one vehicle in each block;

The vehicles can be propelled independently in operation in each block;

The vehicles can be propelled by one or two power propulsion units, as necessary, with one of these units operating under the positive air pressure regime and the other unit operating under the negative air pressure regime, so as to form a dual propulsion circuit;

An assembly consisting of a section isolation valve and an atmospheric valve, installed ahead of and after each station, provides an isolation circuit, so as to separate the propulsion circuits ahead of and after the station; and A secondary propulsion circuit equipped with a secondary duct and two coupled flow control valves allows the power propulsion unit that is installed behind the station platform to propel a vehicle when the vehicle is located in the extension of the guideway within the station.

The elements of the propulsion system involved in the operation of a vehicle in the block between two consecutive stations include the propulsion duct formed by the guideway (1) and, associated with the originating station (9), the following elements, which are repeated respectively in connection with the other stations: A power propulsion unit (3), installed behind the platform of the station (9), connected to the guideway duct by means of a secondary propulsion circuit with a secondary duct (7) and two flow control valves (4) (4'); an assembly consisting of a section isolation valve and an atmospheric valve, installed ahead of and behind the boarding or loading platform on the station (9) in order to separate the propulsion circuits for the blocks ahead of and behind the station, including the valves (2) (2') (6) (6'), which are associated with the station (9). A second power propulsion unit (3") is installed between the position of the atmospheric valve (2) and the section isolation valve (6).

The operation of the vehicle reflects the travel direction defined as being from station (9) to station (9').

In order for a vehicle to begin a trip from a station (9), the flow control valves in the power propulsion unit (3) are positioned such that an airflow is provided under the positive air pressure regime. In the secondary propulsion circuit, the flow control valve (4) is closed and the flow control valve (4') is open, such that the airflow under the positive air pressure regime is directed into the guideway duct behind the vehicle and consequently pushes the vehicle. The section isolation valve (6) is closed, isolating the present circuit from the preceding block. The section isolation valve (6') is open in order to allow passage of the vehicle propulsion plate. The atmospheric valve (2') is closed. The section isolation valve (6") is closed in order to isolate the block in which the vehicle is located from the following block. The flow control valves in the power propulsion unit (3'") are positioned so that an airflow under the negative air pressure regime is provided. The atmospheric valve (2") is closed.

With this valve configuration, the vehicle is displaced from the station (9) toward the station (9'), by means of the dual propulsion circuit. In other words, while the power propulsion unit (3) is pushing the vehicle by means of positive air pressure, the power propulsion unit (3'") is pulling the vehicle by providing negative air pressure.

After the vehicle passes the point at which the secondary duct is connected, which point is located immediately after the section isolation valve (6'), the flow control valve (4) in the secondary propulsion valve is opened, and the flow control valve (4') is closed. Then the section isolation valve (6') is closed, the atmospheric valve (2') is opened (if dual propulsion is not utilized in the preceding block), and the section isolation valve (6) is opened.

With this new valve configuration, the vehicle continues to be propelled in the direction of the destination station (9'), but the preceding block is released in the region in front of the boarding or loading platform of the station (9) for the vehicle in the preceding block to enter. Similarly, in the current block, the valves near the station (9') toward which the vehicle is en route are respectively positioned such that the vehicle reaches the end of the block, i.e., the section isolation valve (6'") is closed, the atmospheric valve (2'") is opened to allow the airflow to exit from the duct (but only if dual propulsion is not being used), and the section isolation valve (6') is opened.

When dual propulsion is no longer necessary, the flow control valves in the power propulsion unit (3'") are closed, thereby cutting off the generated airflow. Then the atmospheric valve (2") is opened in order to allow the airflow to be discharged from the duct into the atmosphere. Dual propulsion may be used only when the vehicle is ahead of the position of the power propulsion unit (3'").

When the vehicle enters the deceleration phase, in order to stop at the station (9'), and if propulsive thrust is not necessary, then the control valves in the power propulsion unit (3) are closed or even positioned in such a way that the track duct is connected to the atmosphere, however without the provision of an airflow by the power propulsion unit.

This description of the operation of a vehicle in a block between two consecutive stations also applies to all of the blocks designed for a line or for. a network in a transportation system with various stations or stops. The positions of the valves as a function of the position of the vehicle on the track and as a function of the amount of propulsion necessary reflect, respectively, the same positions defined in the preceding description.

Figure 23:
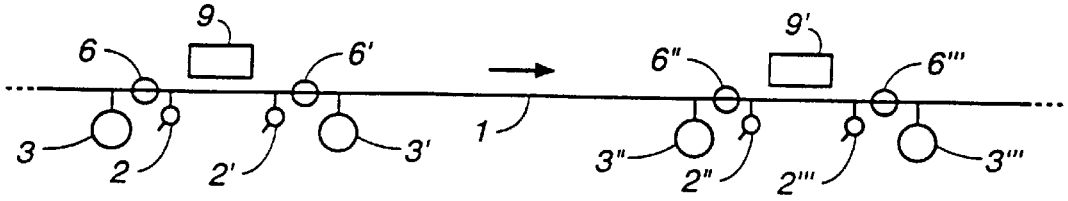

The arrangement of the elements of the propulsion system as shown in FIG. 23 allows vehicles to operate in one direction of travel, on a line with as many stations as necessary, with the option of operating all of the vehicles simultaneously, each in its own respective block between two consecutive stations. This arrangement is appropriate for dual guideway lines, with independent tracks for each direction of traffic of vehicles in operation in the system within a transportation network.

This arrangement provides the following options:

Simultaneous operation of as many vehicles as there are blocks between stations, with one vehicle in each block;

The vehicles can be propelled independently for operation in each block;

The vehicles can be propelled by one or two power propulsion units, as necessary, with one of these units operating under the positive air pressure regime and the other unit operating under the negative air pressure regime, so as to form a dual propulsion circuit in which the power propulsion unit behind the vehicle generates an airflow under the positive air pressure regime, pushing the vehicle, while the power propulsion unit located in front of the vehicle generates an airflow under the negative air pressure regime, pulling the vehicle;

An assembly consisting of a section isolation valve and an atmospheric valve, installed on the guideway ahead of and after the boarding or loading platform in each station, isolates the guideway blocks behind and in front of the station location;

The inclusion of two power propulsion units for each vehicle provides redundancy in the event of any failure in a power propulsion unit in the block in which the vehicle is located. The failure of a power propulsion unit will not prevent another power propulsion unit from operating, albeit with a lower performance, depending on the loading of the vehicle and on the need to use dual propulsion;

The arrangement of the elements of the propulsion system in the block between two consecutive stations is symmetrical, allowing the vehicles on a line or transportation network to be displaced or propelled in one direction of travel or the other; and The manoeuvring of the vehicle in the stretch of guideway within the boarding or loading platform is carried out through use of the power propulsion unit installed after the station in which the vehicle is arriving.

The elements of the propulsion system involved in the operation of a vehicle include the propulsion duct formed by the guideway (1) and, associated with each station (9), a power propulsion unit (3), a section isolation valve (6), and an atmospheric valve (2) located ahead of the boarding or loading platform of the station, and a power propulsion unit (3'), a section isolation valve (6'), and an atmospheric valve (2') located behind the boarding or loading platform of the station.

For purpose of the description of the operation of the vehicle, the direction of travel of the vehicle on the guideway is defined as being from station (9) to station (9'). However, because the arrangement of the elements of the propulsion system along the length of the block between stations is symmetrical, the vehicle can also be operated in the opposite direction.

Starting from a station (9), the vehicle is propelled by the power propulsion unit (3'), whose flow control valves are positioned such that an airflow is provided under the negative air pressure regime, in order to pull the vehicle. The section isolation valve (6) is closed in order to isolate the block before the station (9). The atmospheric valve (2) is open to allow the entry of air from the atmosphere into the guideway duct; the atmospheric valve (2') is closed, opening only when the section isolation valve (6') is closed, in order to allow air to be discharged from the duct into the atmosphere when the vehicle from the preceding block is arriving in the station (9). The section isolation valve (6') is open in order to allow passage of the vehicle propulsion plate. As long as the vehicle has not passed the position of the power propulsion unit (3'), this group will not provide a propulsive airflow, instead keeping its flow control valves closed. The section isolation valve (6") will also stay closed while the vehicle is being pulled by the power propulsion unit (3").

After the vehicle has passed the location of the power propulsion unit (3'), this power propulsion unit can start to provide the airflow under the positive air pressure regime, in order to form a dual propulsion circuit in conjunction with the power propulsion unit (3"). For this purpose, the section isolation valve (6') is closed, and the flow control valves in the power propulsion unit (3') are positioned in such a way as to generate an airflow under the positive air pressure regime.

With this valve configuration, the vehicle is propelled in the direction of the destination station (9') until the beginning of the deceleration stage or until the vehicle reaches a position close to that of the power propulsion unit (3"), at which point this power propulsion unit stops providing the propulsive airflow, closing its flow control valves. With this event, the section isolation valve (6") opens in order to allow passage of the vehicle propulsion plate; the atmospheric valve (2) is closed; the section isolation valve (6''') is kept closed, and the atmospheric valve (2''') is opened in order to allow the airflow to exit from the duct into the atmosphere.

If propulsion is still necessary for the vehicle in this stage, the power propulsion unit (3') continues to provide an airflow under the positive air pressure regime. If propulsion is no longer necessary, the power propulsion unit (3') stops providing an airflow, and its flow control valves are closed or even positioned in such a way that the guideway duct is linked to the atmosphere, however without the provision of an airflow by the power propulsion unit. The description of the operation of a vehicle in a block between two consecutive stations also applies to all of the blocks designed for a line or for a network in a transportation system with a various stations or stops. The positions of the valves as a function of the position of the vehicle on the guideway and as a function of the amount of propulsion necessary reflect, respectively, the same positions defined in the preceding description.

Figure 24:
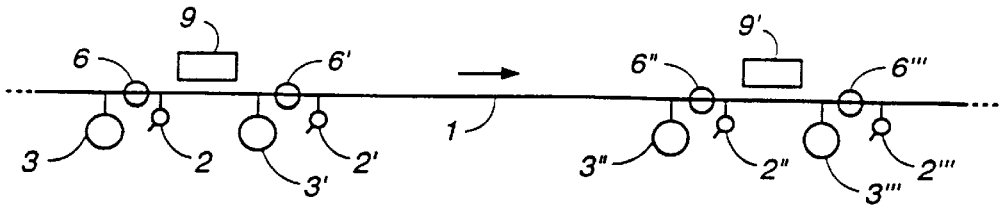

The arrangement of the elements of the propulsion system as shown in FIG. 24 allows vehicles to operate in one direction of travel, on a line with as many stations as necessary, with the option of operating all of the vehicles simultaneously, each in its own respective block between two consecutive stations. This arrangement is appropriate for dual guideway lines, with independent tracks for each direction of traffic of vehicles in operation in the system within a transportation network.

This arrangement provides the following, options:

Simultaneous operation of as many vehicles as there are blocks between stations, with one vehicle in each block;

The vehicles can be propelled independently for operation in each block;

The vehicles can be propelled by one or two power propulsion units, as necessary, with one of these units operating under the positive air pressure regime and the other unit operating under the negative air pressure regime, so as to form a dual propulsion circuit in which the power propulsion unit behind the vehicle generates an airflow under the positive air pressure regime, pushing the vehicle, while the power propulsion unit located in front of the vehicle generates an airflow under the negative air pressure regime, pulling the vehicle;

An assembly consisting of a section isolation valve and an atmospheric valve, installed ahead of and after the boarding or loading platform in each station, implements the isolation of the blocks behind and in front of the station;

The presence of two power propulsion units for each vehicle provides redundancy in the event of any failure in a power propulsion unit in the block in which the vehicle is located. The failure of a power propulsion unit will not prevent another power propulsion unit from operating, albeit with a lower level of performance, depending on the loading of the vehicle and on the need to use dual propulsion; and The manoeuvring of the vehicle in the stretch of guideway within the boarding or loading platform is carried out through use of the power propulsion unit installed after the station in which the vehicle is arriving.

This propulsion arrangement differs from the preceding one only in terms of the relative position of the power propulsion unit in relation to the atmospheric valves and the section isolation valve installed after the boarding or loading platform in the station. Whereas in the preceding arrangement the manoeuvring of the vehicle in the stretch of guideway within the station in which the vehicle is-arriving is carried out through use of the power propulsion unit installed immediately after the preceding station, in this arrangement the power propulsion unit utilized for the same purpose allows a more rapid response by the vehicle to the propulsion actions.

The elements of the propulsion system involved in the operation of a vehicle include the propulsion duct formed by the guideway (1) and, associated with each station (9), a power propulsion unit (3), a section isolation valve (6), and an atmospheric valve (2) located ahead of the boarding or loading platform of the station, and a power propulsion unit. (3'), a section isolation valve (6'), and an atmospheric valve (2') located behind the boarding or loading platform of the station.

For purposes of the description of the operation of the vehicle, the direction of travel of the vehicle on the track is defined as being from station (9) to station (9').

Starting from a station (9), the vehicle is propelled by the power propulsion unit (3'), whose flow control valves are positioned such that an airflow is provided under the negative air pressure regime, in order to pull the vehicle. The section isolation valve (6) is closed in order to isolate the block before the station (9). The atmospheric valve (2) is open to allow the entry of air from the atmosphere into the guideway duct; the atmospheric valve (2') is closed, opening only when the section isolation valve (6') is closed, in order to allow air to be discharged from the duct into the atmosphere when the vehicle from the preceding block is arriving in the station (9). The section isolation valve (6') is open in order to allow passage of the vehicle propulsion plate. As long as the vehicle has not passed the position of the power propulsion unit (3'), this group will not provide a propulsive airflow, instead keeping its flow control valves closed. The section isolation valve (6") will also stay closed while the vehicle is being pulled by the power propulsion unit (3").

After the vehicle has passed the location of the power propulsion unit (3'), this power propulsion unit can start to provide the airflow under the positive air pressure regime, in order to form a dual propulsion circuit in conjunction with the power propulsion unit (3"). For this purpose, the atmospheric valve (2) is closed, and the flow control valves in the power propulsion unit (3') are positioned in such a way as to generate an airflow under the positive air pressure regime.

With this valve configuration, the vehicle is propelled in the direction of the destination station (9'), until the beginning of the deceleration phase or until the vehicle reaches a position close to that of the power propulsion unit (3"), at which point this power propulsion unit stops providing the propulsive airflow, closing its flow control valves. As the vehicle from the preceding block approaches the station (9), the power propulsion unit (3') will also stop providing the airflow, shifting to propelling the vehicle of the preceding block. When the power propulsion unit (3") stops providing the airflow, the section isolation valve (6") opens in order to allow passage of the vehicle propulsion plate; the atmospheric valve (2") is closed; and the section isolation valve (6'") is kept closed.

If propulsion is still necessary for the vehicle in this stage, the power propulsion unit (3'") shifts into providing an airflow under the negative air pressure regime. If propulsion is no longer necessary, the power propulsion unit (3'") stops providing an airflow, and its flow control valves are positioned in such a way that the track duct is linked to the atmosphere, however without the provision of an airflow by the power propulsion unit.

This description of the operation of a vehicle in a block between two consecutive stations also applies to all of the blocks designed for a line or for a network in a transportation system with various (many) stations or stops. The positions of the valves as a function of the position of the vehicle on the guideway and as a function of the amount of propulsion necessary, reflect, respectively, the same positions defined in the preceding description.

Figure 25:
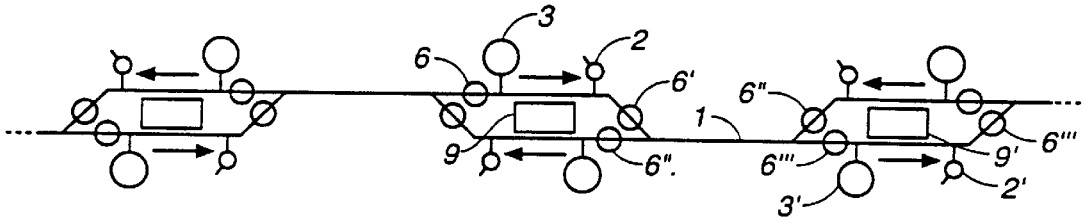

The arrangement of the elements of the propulsion system as shown in FIG. 25 allow vehicles to operate simultaneously, one in each block, between stations on a single track guideway provided with switches located before and after each station. The alignment of adjacent guideway tracks along either side of the boarding or loading platforms of each station allows vehicles in adjacent guideway blocks, moving in opposite directions, to cross each other at the station location, and allows each vehicle to subsequently occupy the guideway section previously occupied by the other vehicle.

In each station, this arrangement also includes a power propulsion unit located on each side of the boarding or loading platform, two section isolation valves, and one atmospheric valve, thereby allowing the propulsion circuit for the following block to be selected and controlled.

This arrangement of the elements of the propulsion system makes it possible to:

Operate a vehicle in each block between stations simultaneously;

Operate vehicles in both directions on a single guideway track line;

Propel vehicles by means of one or two power propulsion units, as necessary; and Operate under a positive air pressure regime and also under a negative air pressure regime, thereby forming a dual propulsion circuit, in which the power propulsion unit located behind the vehicle generates an airflow under a positive air pressure regime, pushing the vehicle, while the power propulsion unit located in front of the vehicle generates an airflow under the negative air pressure regime, pulling the vehicle.

The elements of the propulsion system involved in the operation of a vehicle in a block between two consecutive stations include the propulsion duct formed by the guideway (1) and also the following elements, which are installed in association with each station, in the region of the track located on each side of the boarding or loading platform of the station: a power propulsion unit (3), two section isolation valves (6) (6'), and one atmospheric valve (2).

The direction of travel of a vehicle in each section between stations alternates every time another vehicle is operating in the guideway track block. In combined operation of all of the vehicles on a line in a transportation system with various stations, the vehicles in operation, simultaneously in two adjacent blocks,. either move toward the station that separates the blocks, or move away toward the nearest stations at the end of the adjacent blocks.

When a vehicle is in operation from a station (9) toward a station (9'), the power propulsion unit (3) positions its flow control valves in such a way as to provide an airflow under the positive air pressure regime, and the power propulsion unit (3') positions its flow control valves in such a way as to provide an airflow under the negative air pressure regime, so that these two groups considered together form a dual propulsion circuit. The section isolation valve (6) is closed, isolating the block in which the vehicle will enter from the adjacent block. The atmospheric valve (2) is closed; the section isolation valve (6') is open; the section isolation valve (6") is open; the atmospheric valve (2') is closed; and the isolation valve (6'") is open. The section isolation valve (6") is closed for the operation of the other vehicle in the adjacent block, in joint action with the valve (6) of the block in question.

With this valve configuration, the Vehicle moves from the station (9) to the station (9'). If it is necessary to use the dual propulsion circuit, the power propulsion unit (3') closes its flow control valves so that it does not provide a propulsive airflow, and the atmospheric valve (2') is opened in order to allow the airflow to be discharged from the duct into the atmosphere.

When the vehicle begins the deceleration phase, the power propulsion unit (3') closes its flow control valves in order to stop providing the propulsive airflow. The atmospheric valve (2') is opened in order to allow the airflow to be discharged from the duct into the atmosphere. At the same time; the power propulsion unit (3) closes its flow control valves in order to cut off the propulsive airflow, or even positions its flow control valves in such a way that the guideway duct is linked to the atmosphere, however without the provision of an airflow by the power propulsion unit.

This description of the operation of a vehicle in a block between two consecutive stations also applies to all of the blocks designed for a line or for a network in a transportation system with a various stations or stops. The positions of the valves as a function of the position of the vehicle on the guideway and as a function of the amount of propulsion necessary, reflect, respectively, the same positions defined in the preceding description.

Figure 26:
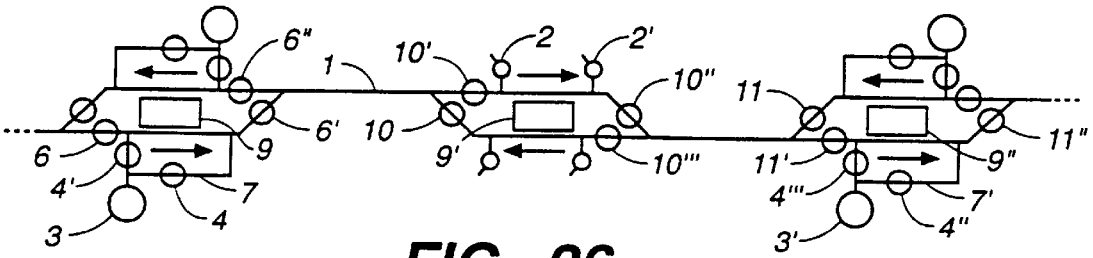

The arrangement of the elements of the propulsion system as shown in FIG. 26 allow vehicles to operate simultaneously, one in each block, between stations on a single track guideway provided with switches located before and after each station. The alignment of adjacent guideway tracks along either side of the boarding or loading platforms of each station allows vehicles in adjacent guideway blocks, moving in opposite directions, to cross each other at the station location, and allows each vehicle to subsequently occupy the guideway section previously occupied by the other vehicle. The stations include power propulsion units alternately, one station with such a unit and the next one without. The stations that have power propulsion units have, on each side of the station, a power propulsion unit connected to the guideway duct by means of a secondary propulsion circuit consisting of a secondary duct and two flow control valves, plus two section isolation valves that are responsible for isolating the propulsion circuits of the adjacent blocks. The stations that do not have power propulsion units have two section isolation valves and two atmospheric valves installed on each side of the station.

This arrangement of the elements of the propulsion system makes it possible to:

- Operate a vehicle in each block between stations, simultaneously;
- Operate vehicles in both directions on a single guideway line; and
- Propel vehicles by means of one or two power propulsion units, as necessary.

The elements of the propulsion system involved in the operation of a vehicle in a block between two consecutive stations include the propulsion duct formed by the guideway (1) plus the following elements, installed in association with each station, regardless of whether the station has a power propulsion unit.

For stations that do have added power propulsion units, such as the station (9), the elements of the propulsion system installed in the guideway duct on each side of the boarding or loading platform of the station include a power propulsion unit (3) connected to the duct formed by the guideway (1) by means of a secondary propulsion circuit consisting of a secondary duct (7) and two flow control valves (4) (4'), with the secondary duct being linked to the guideway duct before and after the station boarding or loading platform; two section isolation valves (6) (6'), which are installed one before and one after the locations on the guideway duct at which the secondary duct in the secondary propulsion circuit is connected.

For stations that do not have added power propulsion units, such as the station (9'), the elements of the propulsion system installed in the guideway duct on each side of the boarding or loading platform of the station include two atmospheric valves (2) (2') and two section isolation valves (10') (10").

A vehicle departing from a station (9) that does have an added power propulsion unit, en route to a station (9') that does not have an added power propulsion unit, is operated in accordance with the sequence of steps described below.

The propulsion circuit is delimited by the extent or length of the guideway included between the section isolation valves (6) (10'"), which are closed. The atmospheric valve (2') is open in order to allow the airflow to be discharged from the duct into the atmosphere. The power propulsion unit (3) has its flow control valves set such that an airflow is provided under the positive air pressure regime. In the secondary propulsion circuit, the flow control valve (4') is open and the flow control valve (4) is closed, so as to direct the airflow produced by the power propulsion unit so that this airflow acts on the anterior portion of the vehicle propulsion plate, pushing it. In order to ensure the continuity of the propulsion circuit from the station (9) to the station (9'), the section isolation valves (6') (10') are open, the section isolation valve (10) is closed, the atmospheric valve (2) is closed, and the section isolation valves (6") (10") are closed.

With this valve configuration, the propulsion circuit allows the vehicle to travel from the station (9) to the station (9'). Before reaching the station (9'), when the vehicle starts the deceleration phase, if there is no further need for propulsion, the flow control valves in the power propulsion unit (3) are closed, thereby stopping the generation of the propulsive airflow. Alternatively, these same valves are positioned in such a way that the guideway duct is linked to the atmosphere, however without the. provision of an airflow by the power propulsion unit.

A vehicle departing from a station (9') that does not have an added power propulsion unit, en route to a station that does have an added power propulsion unit, is operated in accordance with the sequence of steps described below.

The propulsion circuit is delimited by the extent or length of the guideway included between the section isolation valves (10') (11"), which are closed. The atmospheric valve (2) is open in order to allow the airflow to be discharged from the duct into the atmosphere. The power propulsion unit (3') has its flow control valves set such that an airflow is provided under the negative air pressure regime, so as to pull the vehicle. In the secondary propulsion circuit, which is linked to the power propulsion unit (3'), the flow control valve (4") is open and the flow control valve (4) is closed, so as to direct the airflow produced by the power propulsion unit (3') toward the position behind the boarding or loading platform of the station (9"), thereby allowing the vehicle to be pulled to a position in front of the boarding or loading platform. In order to ensure the continuity of the propulsion circuit from the station (9') to the station (9'), the section isolation valves (10") (11') are open, the atmospheric valve (2') is closed, and the section isolation valves (10) (11) are closed.

With this valve configuration the propulsion circuit allows the vehicle to travel from the station (9') to the station (9"). Before reaching the station (9"), when the vehicle starts the deceleration phase, if there is no further need for propulsion, the flow control valves in the power propulsion unit (3') are closed, thereby stopping the generation of the propulsive airflow. Alternatively, these same valves are positioned in such a way that the track duct is linked to the atmosphere, however without the provision of an airflow by the power propulsion unit.

The foregoing description of the operation of a vehicle in a block between two consecutive stations also applies to all of the blocks designed for a line or for a network in a transportation system with various stations or stops. The positions of the valves as a function of the position of the vehicle on the track and as a function of the amount of propulsion necessary, reflect, respectively, the same positions defined in the preceding description.

What is claimed is:

1. A pneumatic control circuit for the operation of pneumatically propelled vehicles on a guideway, said pneumatic control circuit including a propulsion duct (1) in said guideway providing an airflow path therethrough, at least one power propulsion unit (3) connected to said propulsion duct for selectively providing positive or negative air pressure in said propulsion duct, section isolation valves (6) provided in said propulsion duct for opening and closing the airflow path through said propulsion duct at selected intervals so as divide said propulsion duct into adjacent isolatable sections defining a guideway block, and atmospheric valves (2) provided in the propulsion duct for opening and closing the propulsion duct to atmosphere, characterized in that said pneumatic control circuit has at least one secondary air duct (7) located in parallel relation to said propulsion duct (1) and pneumatically connected to said propulsion duct at two spaced apart connection points, said secondary duct including a power propulsion unit (3) and air flow control valves (4,4') for operatively connecting the power propulsion unit of said secondary air duct to said propulsion duct at either one or the other of the connection points for said secondary air duct such that a vehicle inoperatively positioned over one connection point for said secondary duct can be pneumatically propelled by said power propulsion unit from the other of the connection points for said secondary duct.

2. A pneumatic control circuit for the operation of pneumatically propelled vehicles on a guideway, comprising a propulsion duct in the guideway for providing an airflow path therethrough, at least one power propulsion unit connected to said propulsion duct for selectively providing positive or negative air pressure in said propulsion duct for producing airflow therein in a determined direction for propelling a vehicle on the guideway in such determined direction, and a secondary air duct located in parallel relation to said propulsion duct and pneumatically connected to said propulsion duct at two spaced apart connection points to permit air flow between said secondary duct and propulsion duct at said spaced apart connection points, said power propulsion unit being connected to said propulsion duct through said secondary air duct such that the positive or negative air pressure selectively provided to the propulsion duct is selectively provided at only one or the other of said connection points of the secondary duct such that the effective position of the power propulsion unit within said pneumatic control circuit can be selectively changed to provide different desired circuit configurations.

3. The pneumatic control circuit of claim 2 wherein air flow control valve means are operatively connected to said secondary air duct for directing air flow under positive or negative pressure to one or the other of the connections points connecting the secondary air duct to the propulsion duct.

4. The pneumatic control circuit of claim 3 wherein said air flow control valve means includes two air flow control valves, one for controlling air flow through one of said secondary air duct connection points, and the other for controlling air flow through the other of said secondary air duct connection points.

5. The pneumatic control circuit of claim 4 wherein said two air flow control valves have the following operative states: one of said two air flow control valves is open and the other of said air control valves is closed to connect the power propulsion unit to the propulsion duct at a selected one of the secondary duct connection points, and the said one of said air control values is closed and said other of said air flow control valves is open to connect the power propulsion unit to the propulsion duct at the other one of the secondary duct connection points.

6. The pneumatic control circuit of claim 2 further comprising at least one atmospheric valve in said propulsion duct operative to open and close said propulsion duct to atmosphere, said atmospheric valve being located at a distance from said secondary air duct so that, when said atmospheric valve is opened, an air flow can be established in a section of the propulsion duct between a selected one of the secondary duct connection points and said atmospheric valve, the direction of the air flow in said section of propulsion duct being determined by the positive or negative air pressure supplied by said power propulsion unit.

7. The pneumatic control circuit of claim 2 further comprising at least two atmospheric valves in said propulsion duct having open and closed states to open and close said propulsion duct to atmosphere, one of said atmospheric valves being an upstream atmospheric valve located at a distance in one direction from said secondary air duct so that, when said upstream atmospheric valve is opened, an air flow can be established in an upstream section of the propulsion duct between a selected one of the secondary duct connection points and said upstream atmospheric valve, the direction of the air flow in said upstream section of propulsion duct being determined by the positive or negative air pressure supplied by said power propulsion unit, and the other of said atmospheric valves being a downstream atmospheric valve located at a distance in the other direction from said secondary air duct so that, when said atmospheric valve is opened, an air flow can be established in an downstream section of the propulsion duct between a selected one of the secondary duct connection points and said downstream atmospheric valve, the direction of the air flow in said downstream section of propulsion duct being determined by the positive or negative air pressure supplied by said power propulsion unit, wherein the power propulsion unit connected to the propulsion duct through the secondary air duct operates in a positive air pressure state or negative air pressure state, and wherein a vehicle propelled on the guideway can be passed between the upstream and downstream sections of the propulsion duct by reversing i) the open and closed states of said upstream and downstream atmospheric valves, ii) the secondary air duct connection point to which the power propulsion unit is connected, and iii) the air pressure state of the power propulsion unit.

8. The pneumatic control circuit of claim 2 further comprising a cooperative valve set in said propulsion duct between the two spaced apart secondary air duct connection points, said cooperative valve set being comprised of an atmospheric valve in said propulsion duct operative to open and close said propulsion duct to atmosphere and a section isolation valve in said propulsion duct adjacent said atmospheric valve for opening and closing the airflow path through said propulsion duct, wherein said valve set is operative to selectively isolate the propulsion duct into adjacent sections by opening the atmospheric valve and closing the section isolation valve, and wherein one of the secondary air duct connection points is connected to one of said adjacent sections of the propulsion duct and the other of the secondary air duct connection points is connected to the other of said adjacent sections of the propulsion duct so that said power propulsion unit can be connected to a selected one of the adjacent sections of the propulsion duct when isolated by said cooperative valve set.

9. The pneumatic control circuit of claim 2 wherein a succession of at least two secondary air ducts are provided along the propulsion duct for connecting a succession of at least two power propulsion units to the propulsion duct, and wherein each power propulsion unit in said succession of power propulsion units is selectively connected to said propulsion duct at one or the other of said connection points of its associated secondary duct.

10. The pneumatic control circuit of claim 9 further comprising at least one cooperative valve set in said propulsion duct between the two secondary air ducts, said cooperative valve set being comprised of an atmospheric valve in said propulsion duct operative to open and close said propulsion duct to atmosphere and a section isolation valve in said propulsion duct adjacent said atmospheric valve for opening and closing the airflow path through said propulsion duct, wherein said cooperative valve set is operative to selectively isolate the propulsion duct into adjacent sections by opening the atmospheric valve and closing the section isolation valve, each of said adjacent sections containing a power propulsion unit connected thereto through one of said secondary air ducts.

11. The pneumatic control circuit of claim 2 further comprising a cooperative valve set including an atmospheric valve in said propulsion duct for opening and closing said propulsion duct to atmosphere and a section isolation valve in said propulsion duct adjacent said atmospheric valve for opening and closing the airflow path through said propulsion duct at said section isolation valve, said cooperative valve set being located at a distance from said secondary duct so that, when said atmospheric valve is opened and said section isolation valve is closed, the propulsion duct is isolated into adjacent sections and an air flow path is established in the isolated section of the propulsion duct with said open atmospheric valve, said established air flow path extending between a selected one of the secondary duct connection points and said atmospheric valve.

12. The pneumatic control circuit of claim 11 wherein the cooperative valve set at a distance from said secondary duct is a first cooperative valve set, and wherein a second co-operative valve set is provided in said propulsion duct at a location adjacent said secondary duct to the opposite side of the secondary duct from said first cooperative valve set, said first and second cooperative valve sets dividing the propulsion duct into successive sections including a section containing said secondary duct and power propulsion unit, and permitting the selective isolation of said successive sections one from the other and the establishment of desired air flow paths within sections of the propulsion duct including an airflow path between a selected one of the secondary duct connection points and the atmospheric valve of said first cooperative valve set.

13. The pneumatic control circuit of claim 2 wherein the power propulsion unit connected to said propulsion duct through said secondary duct is defined as a first power propulsion unit and wherein the pneumatic control circuit further comprises a second power propulsion unit connected to said propulsion duct at a distance from said secondary air duct for providing negative air pressure in said propulsion duct when the first power propulsion unit provides positive air pressure in said propulsion duct at a selected one of the connection points connecting the secondary duct to the propulsion duct, and for providing positive air pressure in said propulsion duct when the first power propulsion unit provides negative air pressure in said propulsion duct at a selected one of said connection points, wherein a vehicle traveling on the guideway is propelled in a push-pull action in the section of the propulsion duct between a selected one of the secondary duct connection points and said second power propulsion unit by the cooperative action of said first and second power propulsion units.

14. The pneumatic control circuit of claim 13 further comprising at least one atmospheric valve in said propulsion duct operative to open and close said propulsion duct to atmosphere, said atmospheric valve being located adjacent said second power propulsion unit, so that, when said atmospheric valve is opened, an air flow path is established between a selected one of the secondary duct connection points and said atmospheric valve, said air flow path permitting the second power propulsion unit to be disengaged when the push-pull action provided by two power propulsion units is not required.

15. The pneumatic control circuit of claim 13 further comprising a section isolation valve in said propulsion duct for opening and closing the airflow path through said propulsion duct at said section isolation valve, said section isolation valve being located adjacent said second power propulsion unit and on the opposite side of said second power propulsion unit from said atmospheric value, said section isolation valve, in cooperation with either said atmospheric valve or second power propulsion unit, being operative to selectively isolate the propulsion duct into adjacent operable sections by closing the section isolation valve and either opening said atmospheric valve or operating said second power propulsion unit in push-pull fashion with said first power propulsion unit.

16. A pneumatic control circuit for the operation of pneumatically propelled vehicles on a guideway, comprising a propulsion duct in the guideway for providing an airflow path therethrough, a secondary air duct located in parallel relation to said propulsion duct and pneumatically connected to said propulsion duct at two spaced apart first and second connection points, a power propulsion unit connected to said secondary air duct and capable of selectively providing positive or negative air pressure therein, a first air flow control valve positioned in said secondary air duct between said power propulsion unit and the first connection point connecting said secondary air duct to said propulsion duct, and a second air flow control valve positioned in said secondary air duct between said power propulsion unit and the second connection point connecting said secondary air duct to said propulsion duct, said first and second air flow control valves being operative to selectively connect said power propulsion unit to said propulsion duct through one or the other of said first or second connection points.

17. The pneumatic control circuit of claim 16 wherein said power propulsion unit is positioned near the first connection point of said secondary air duct and wherein the secondary air duct extends the second connection point to the propulsion duct to a position on the propulsion duct spaced at a distance from the power propulsion unit.

18. A pneumatic transportation system comprising a pneumatic guideway, at least one station along said pneumatic guideway, and a pneumatic control circuit for the operation of pneumatically propelled vehicles on said guideway, said pneumatic control circuit including a propulsion duct in said guideway for providing an airflow path therethrough, at least one power propulsion unit connected to said propulsion duct for selectively providing positive or negative air pressure in said propulsion duct for producing airflow therein in a determined direction for propelling a vehicle on the guideway in such determined direction, and a secondary air duct located in parallel relation to said propulsion duct, said secondary air duct being pneumatically connected to said propulsion duct at two spaced apart connection points to permit air flow between said secondary duct and propulsion duct at said spaced apart connection points, said secondary duct connection points defining a secondary duct propulsion zone in said propulsion duct between said connection points, said secondary duct propulsion zone being located at said station, said power propulsion unit being connected to said propulsion duct through said secondary air duct such that the positive or negative air pressure selectively provided to the propulsion duct is selectively provided at only one or the other of said connection points of the secondary duct, such that, the effective position of the power propulsion unit within said pneumatic control circuit can be selectively changed to allow said power propulsion unit to alternatingly pull a vehicle into said secondary duct propulsion zone and hence into the station opposite said secondary duct propulsion zone, and push said vehicle out of said secondary duct propulsion zone and hence out of said station.

19. The pneumatic transportation system of claim 18 further comprising first and second section isolation valves in said propulsion duct for opening and closing the airflow path through said propulsion duct, said section isolation valves being located on opposite sides of and adjacent the secondary duct propulsion zone, such that, when one said section isolation valve is opened and the other is closed, air flow can be established in said secondary duct propulsion zone in a negative pressure regime for pulling a vehicle into said station from a direction opposite the closed section isolation valve, and such that, when the open and closed states of said section isolation valves are thereafter reversed, air flow can be established in said secondary duct propulsion zone in a positive pressure regime for pushing a vehicle out of said station in a direction opposite the closed section isolation valve.

20. The pneumatic transportation system of claim 19 further comprising an atmospheric valve in said propulsion duct adjacent each said section isolation valves on the side of said section isolation valves opposite said secondary duct propulsion zone, said atmospheric valves being operative to open and close said propulsion duct to atmosphere, said atmospheric valves and section isolation valves forming a cooperative valve set at each side of said secondary duct propulsion zone which permits selective isolation from, and air flows in, adjacent sections of the propulsion duct for bringing vehicles into and moving vehicles out of the station.

21. The pneumatic transportation system of claim 18 wherein said pneumatic guideway divides into two guideway branches at said station for receiving two vehicles at the station, wherein each such guideway branch has a propulsion duct for providing an air flow path therethrough, and wherein said secondary duct and power propulsion unit are connected to the propulsion duct of one of said branches to form a secondary duct propulsion zone therein for moving a vehicle into and out said station by pulling and pushing the vehicle into and out of said branch.

22. The pneumatic transportation system of claim 21 wherein two secondary ducts and propulsion units are provided, one secondary duct being connected to the propulsion duct of each branch of the guideway to provide a secondary duct propulsion zone in the propulsion duct of each such branch, and one propulsion unit being connected to the propulsion duct of each guideway branch through said secondary ducts.

23. The pneumatic transportation system of claim 21 further comprising a pair of section isolation valves for opening and closing the airflow path through the propulsion duct, said pair of section isolation valves being located in the branch of the propulsion duct containing said secondary duct propulsion zone, one of said pair of isolation valves being placed on each side of said propulsion zone such that such branch can be selectively isolated from the remainder of said propulsion duct.

24. The pneumatic transportation system of claim 23 wherein two secondary ducts, propulsion units, and pairs of section isolation valves are provided, one secondary duct being connected to the propulsion duct in each branch of the guideway to provide a secondary duct propulsion zone in the propulsion duct of each such branch, one propulsion unit being connected to the propulsion duct of each branch of the guideway through said secondary ducts, and one pair of section isolation valves being provided in the propulsion duct of each guideway branch to permit selective isolation of the propulsion duct in said branch from the remainder of the propulsion duct.

25. A pneumatic transportation system comprising a pneumatic guideway, at least two stations along said pneumatic guideway, and a propulsion duct in said guideway for providing an airflow path therethrough, at least one power propulsion unit associated with each station connected to said propulsion duct for selectively providing positive or negative air pressure in said propulsion duct for producing airflow therein in a determined direction for propelling a vehicle on the guideway in such determined direction, and a secondary air duct associated with each said station, each said secondary duct being located in parallel relation to said propulsion duct and being pneumatically connected to said propulsion duct at two spaced apart connection points to permit air flow between said secondary duct and propulsion duct at said spaced apart connection points, said secondary duct connections points defining a secondary duct propulsion zone in said propulsion duct between said connection points, the secondary duct propulsion zones defined by said secondary ducts being located at the stations along said guideway, the power propulsion units associated with each said station being connected to said propulsion duct through the secondary air ducts associated with said stations, such that, the positive or negative air pressure selectively provided to the propulsion duct at the associated station is selectively provided at only one or the other of said connection points of the secondary duct such that the effective position of the power propulsion units along said propulsion duct relative to said stations can be selectively changed to allow said power propulsion unit to alternatingly pull a vehicle into said secondary duct propulsion zones and hence into the stations and push said vehicle out of said secondary duct propulsion zones and hence out of said stations.

26. The pneumatic transportation system of claim 25 further comprising at least one cooperative valve set associated with and adjacent each of the secondary duct propulsion zones in said propulsion duct, each of said valve sets having an atmospheric valve in said propulsion duct operative to open and close said propulsion duct to atmosphere and a section isolation valve in said propulsion duct adjacent said atmospheric valve for opening and closing the airflow path through said propulsion duct, said cooperative valve sets being operative to selectively isolate the secondary duct propulsion zone at one station from the section of the propulsion duct between stations while establishing a desired air flow through such section of propulsion duct.

27. The pneumatic transportation system of claim 25 comprising two cooperative valve sets associated with each of the secondary duct propulsion zones in said propulsion duct, one valve set being provided adjacent each side of each secondary propulsion zone, each of said valve sets having an atmospheric valve in said propulsion duct operative to open and close said propulsion duct to atmosphere and a section isolation valve in said propulsion duct adjacent said atmospheric valve for opening and closing the airflow path through said propulsion duct, said cooperative valve sets being operative to selectively isolate the secondary duct propulsion zone at either station of the transportation system from sections of the propulsion duct adjacent the stations, while establishing a desired air flow through such adjacent sections of propulsion duct.

28. The pneumatic transportation system of claim 25 wherein a further power propulsion unit is connected to said propulsion duct adjacent one of said stations for providing negative air pressure in the section of propulsion duct between stations when the power propulsion unit connected to the propulsion duct through the secondary duct associated with the other of said stations provides positive air pressure in said propulsion duct at one of the connection points connecting the secondary duct to the propulsion duct, and for providing positive air pressure in said propulsion duct when such other power propulsion unit provides negative air pressure in said propulsion duct at one of said connection points, wherein a vehicle traveling on the section of the propulsion duct between stations is propelled in a push-pull fashion by the cooperative action of said two power propulsion units.

29. The pneumatic transportation system of claim 25 wherein the secondary duct propulsion zone associated with each of said stations has an extension region extending behind said stations and wherein the pneumatic transportation system further comprises two cooperative valve sets associated with each of the secondary duct propulsion zones in said propulsion duct, one valve set of each said two cooperative valve sets being provided in front of each secondary duct propulsion zone and the other of said two cooperative valve sets being provided in the extension region of said secondary duct propulsion zone, each of said valve sets comprising an atmospheric valve in said propulsion duct operative to open and close said propulsion duct to atmosphere and a section isolation valve in said propulsion duct adjacent said atmospheric valve for opening and closing the airflow path through said propulsion duct, said cooperative valve sets being arranged and operative to selectively isolate sections of the propulsion duct between stations and to permit a vehicle to be pushed out of a secondary duct propulsion zone at a station by the power propulsion unit associated with said secondary duct propulsion zone while releasing such secondary duct propulsion zone to receive another vehicle.

30. A pneumatic transportation system comprising a pneumatic guideway, stations along said pneumatic guideway, a propulsion duct in said guideway for providing an airflow path therethrough, cooperative valve sets in said propulsion duct which separate said propulsion duct into isolatable sections, each of said cooperative valve sets including an atmospheric valve for opening and closing said propulsion duct to atmosphere to provide an air flow path in a section of said propulsion duct and a section isolation valve adjacent said atmospheric valve for opening and closing the airflow path through said propulsion duct at the section isolation valve, at least one power propulsion unit associated with each station connected to said propulsion duct for selectively providing positive or negative air pressure in sections of the propulsion duct isolated by said cooperative valve sets and for producing airflow therein in a determined direction for propelling a vehicle through sections of the guideway in such determined direction, and a secondary air duct associated with each said station, each said secondary duct being located in parallel relation to said propulsion duct and being pneumatically connected to said propulsion duct at two spaced apart connection points to permit air flow between said secondary duct and propulsion duct at said spaced apart connection points, said secondary duct connections points defining a secondary duct propulsion zone in said propulsion duct between said connection points, the secondary duct propulsion zones defined by said secondary ducts being located at The stations along said guideway, the power propulsion units associated with each said station being connected to said propulsion duct through the secondary air ducts associated with said stations such that the positive or negative air pressure selectively provided to. the propulsion duct at the associated stations is selectively provided at only one or the other of said connection points of the secondary duct such that the effective position of the power propulsion units along said propulsion duct relative to said stations can be selectively changed to allow said power propulsion unit to alternatingly pull a vehicle into said secondary duct propulsion zones and hence into the stations opposite said secondary duct propulsion zones from an isolated section of the propulsion duct and push said vehicle out of said secondary duct propulsion zones and hence out of said stations into another isolated section of the propulsion duct.

31. The pneumatic transportation system of claim 30 wherein at least one additional power propulsion unit is connected to an isolatable section of said propulsion duct adjacent the atmospheric valve of a valve set for said isolatable section, said additional power propulsion unit being operative to work in push-pull fashion with a power propulsion unit which is connected to the propulsion duct through a secondary duct connection point within the same isolatable section of the propulsion duct.

* * * * *